US011927391B2

(12) United States Patent
Kaminsky et al.

(10) Patent No.: US 11,927,391 B2
(45) Date of Patent: Mar. 12, 2024

(54) LIQUEFACTION OF PRODUCTION GAS

(71) Applicant: ExxonMobil Technology and Engineering Company, Spring, TX (US)

(72) Inventors: Robert D. Kaminsky, Houston, TX (US); Marcel Staedter, Houston, TX (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 0 days.

(21) Appl. No.: 17/647,540

(22) Filed: Jan. 10, 2022

(65) Prior Publication Data

US 2022/0128299 A1 Apr. 28, 2022

Related U.S. Application Data

(62) Division of application No. 16/984,458, filed on Aug. 4, 2020, now abandoned.

(Continued)

(51) Int. Cl.

| | |
|---|---|
| ***F25J 1/00*** | (2006.01) |
| ***F25J 1/02*** | (2006.01) |
| ***F25J 3/02*** | (2006.01) |

(52) U.S. Cl.

CPC ..... *F25J 1/0022* (2013.01); *F25J 1/0032* (2013.01); *F25J 1/005* (2013.01); *F25J 1/007* (2013.01);

(Continued)

(58) Field of Classification Search

CPC ..... F25J 1/0022; F25J 1/0204; F25J 1/0052; F25J 1/0032; F25J 1/0244; F25J 1/0256;

(Continued)

(56) References Cited

U.S. PATENT DOCUMENTS

| | | |
|---|---|---|
| 1,914,337 A | 6/1933 | Belt |
| 1,974,145 A | 9/1934 | Atwell |

(Continued)

FOREIGN PATENT DOCUMENTS

| | | |
|---|---|---|
| CN | 102620523 | 10/2014 |
| CN | 102628635 | 10/2014 |

(Continued)

OTHER PUBLICATIONS

Bach, Wilfried (1990) "Offshore Natural Gas Liquefaction with Nitrogen Cooling—Process Design and Comparison of Coil-Wound and Plate-Fin Heat Exchangers," *Science and Technology Reports*, No. 64, Jan. 1, 1990, pp. 31-37.

(Continued)

*Primary Examiner* — Frantz F Jules
*Assistant Examiner* — Webeshet Mengesha
(74) *Attorney, Agent, or Firm* — Vorys, Sater, Seymour and Pease LLP

(57) ABSTRACT

A method and apparatus for liquefying a feed gas stream comprising natural gas and carbon dioxide. A method includes compressing an input fluid stream to generate a first intermediary fluid stream; cooling the first intermediary fluid stream with a first heat exchanger to generate a second intermediary fluid stream, wherein a temperature of the second intermediary fluid stream is higher than a carbon dioxide-freezing temperature for the second intermediary fluid stream; expanding the second intermediary fluid stream to generate a third intermediary fluid stream, wherein the third intermediary fluid stream comprises solid carbon dioxide; separating the third intermediary fluid stream into a fourth intermediary fluid stream and an output fluid stream, wherein the output fluid stream comprises a liquefied natural gas (LNG) liquid; and utilizing the fourth intermediary fluid stream as a cooling fluid stream for the first heat exchanger.

16 Claims, 10 Drawing Sheets

Related U.S. Application Data

(60) Provisional application No. 62/893,422, filed on Aug. 29, 2019.

(52) U.S. Cl.
CPC ..... *F25J 1/008* (2013.01); *F25J 1/0254* (2013.01); *F25J 3/0214* (2013.01); *F25J 2210/06* (2013.01); *F25J 2210/60* (2013.01); *F25J 2215/04* (2013.01); *F25J 2220/66* (2013.01); *F25J 2260/02* (2013.01); *F25J 2270/04* (2013.01); *F25J 2270/14* (2013.01)

(58) Field of Classification Search
CPC ..... F25J 1/0072; F25J 1/005; F25J 1/0212; F25J 1/0214; F25J 1/0221; F25J 1/0201; F25J 1/0027; F25J 1/0095; F25J 3/06; F25J 3/067
See application file for complete search history.

(56) References Cited

U.S. PATENT DOCUMENTS 2,007,271 A 7/1935 Frankl
2,011,550 A 8/1935 Hasche
2,321,262 A 6/1943 Taylor
2,475,255 A 7/1949 Rollman
2,537,045 A 1/1951 Garbo
2,900,797 A 8/1959 Kurata et al.
2,975,604 A 3/1961 McMahon
2,986,010 A 5/1961 Beckwith
3,014,082 A 12/1961 Woertz, III
3,018,632 A 1/1962 Keith
3,103,427 A 9/1963 Jennings
3,180,709 A 4/1965 Yendall et al.
3,347,055 A 10/1967 Blanchard et al.
3,370,435 A 2/1968 Arregger
3,376,709 A 4/1968 Dickey et al.
3,398,544 A 8/1968 Crownover
3,400,512 A 9/1968 McKay
3,400,547 A 9/1968 Williams et al.
3,511,058 A 5/1970 Becker
3,724,225 A 4/1973 Mancini et al.
3,724,226 A 4/1973 Pachaly
3,850,001 A 11/1974 Locke
3,878,689 A 4/1975 Grenci
4,281,518 A 8/1981 Muller et al.
4,415,345 A 11/1983 Swallow
4,533,372 A 8/1985 Valencia et al.
4,576,005 A * 3/1986 Force ..... C10G 5/06 123/3
4,604,115 A 8/1986 Bonneton et al.
4,609,388 A 9/1986 Adler et al.
4,669,277 A 6/1987 Goldstein
4,769,054 A 9/1988 Steigman
4,923,493 A 5/1990 Valencia et al.
5,025,860 A 6/1991 Mandrin
5,062,270 A 11/1991 Haut et al.
5,120,338 A 6/1992 Potts, Jr. et al.
5,137,558 A 8/1992 Agrawal
5,139,547 A 8/1992 Agrawal et al.
5,141,543 A 8/1992 Agrawal et al.
5,638,698 A 6/1997 Knight et al.
5,950,453 A 9/1999 Bowen et al.
6,003,603 A 12/1999 Breivik et al.
6,053,007 A 4/2000 Victory et al.
6,082,118 A * 7/2000 Endrizzi ..... F17C 11/007 62/46.1
6,082,133 A 7/2000 Barclay et al.
6,158,242 A 12/2000 Lu
6,237,347 B1 5/2001 Rigby et al.
6,295,838 B1 10/2001 Shah et al.
6,298,688 B1 10/2001 Brostow et al.
6,308,531 B1 10/2001 Roberts et al.
6,412,302 B1 7/2002 Foglietta
6,662,589 B1 12/2003 Roberts et al.
6,889,522 B2 5/2005 Prible et al.
7,143,606 B2 12/2006 Trainer
7,219,512 B1 5/2007 Wilding et al.
7,278,281 B2 10/2007 Yang et al.
7,325,415 B2 2/2008 Amin et al.
7,386,996 B2 6/2008 Fredheim et al.
7,520,143 B2 4/2009 Spilsbury
7,712,331 B2 5/2010 Dee et al.
8,079,321 B2 12/2011 Balasubramanian
8,435,403 B2 5/2013 Sapper et al.
8,464,289 B2 6/2013 Pan
8,601,833 B2 12/2013 Dee et al.
8,616,012 B2 12/2013 Duerr et al.
8,616,021 B2 12/2013 Minta
8,747,520 B2 6/2014 Bearden et al.
9,016,088 B2 4/2015 Butts
9,149,761 B2 10/2015 Northrop et al.
9,339,752 B2 5/2016 Reddy et al.
9,435,229 B2 9/2016 Alekseev et al.
9,439,077 B2 9/2016 Gupta et al.
9,459,042 B2 10/2016 Chantant et al.
9,995,521 B2 6/2018 Mogilevsky
10,294,433 B2 5/2019 Grainger et al.
10,696,360 B2 6/2020 Balasubramanian
2003/0196452 A1* 10/2003 Wilding ..... F25J 1/0247 62/613
2004/0177646 A1* 9/2004 Wilkinson ..... F25J 1/0229 62/622
2006/0000615 A1 1/2006 Choi
2007/0277674 A1 12/2007 Hirano et al.
2008/0087421 A1 4/2008 Kaminsky
2008/0302133 A1 12/2008 Saysset et al.
2009/0217701 A1 9/2009 Minta et al.
2010/0192626 A1 8/2010 Chantant
2010/0251763 A1 10/2010 Audun
2011/0036121 A1 2/2011 Roberts et al.
2011/0126451 A1 6/2011 Pan et al.
2011/0259044 A1 10/2011 Baudat et al.
2012/0060553 A1 3/2012 Bauer
2012/0180657 A1 7/2012 Monereau et al.
2012/0285196 A1 11/2012 Flinn et al.
2013/0074541 A1 3/2013 Kaminsky et al.
2013/0199238 A1 8/2013 Mock et al.
2014/0130542 A1 5/2014 Brown et al.
2015/0153101 A1* 6/2015 Gahier ..... F25J 3/0209 62/611
2015/0285553 A1 10/2015 Oelfke et al.
2017/0010041 A1 1/2017 Pierre, Jr. et al.
2017/0016667 A1 1/2017 Huntington et al.
2017/0016668 A1 1/2017 Pierre, Jr. et al.
2017/0167785 A1 6/2017 Pierre, Jr. et al.
2017/0167786 A1 6/2017 Pierre, Jr.
2017/0167787 A1 6/2017 Pierre, Jr. et al.
2017/0167788 A1 6/2017 Pierre, Jr. et al.
2018/0231303 A1 8/2018 Pierre, Jr.
2018/0231305 A1 8/2018 Pierre, Jr.
2018/0292128 A1 10/2018 Degenstein et al.
2020/0248871 A1 8/2020 Kaminsky et al.

FOREIGN PATENT DOCUMENTS

DE 1960515 5/1971
DE 2354726 5/1975
DE 3149847 7/1983
DE 3622145 1/1988
DE 19906602 8/2000
DE 102013007208 10/2014
EP 1715267 10/2006
EP 1972875 9/2008
EP 2157013 8/2009
EP 2629035 8/2013
FR 2756368 5/1998
GB 1376678 12/1974
GB 1596330 8/1981
GB 2172388 9/1986
GB 2333148 7/1999
GB 2470062 11/2010
GB 2486036 11/2012

(56) References Cited

FOREIGN PATENT DOCUMENTS

| | | | |
|---|---|---|---|
| JP | 59216785 | | 12/1984 |
| JP | H0861811 | A | 3/1996 |
| JP | 2530859 | | 4/1997 |
| JP | H1130458 | A | 2/1999 |
| JP | 5705271 | | 11/2013 |
| JP | 5518531 | | 6/2014 |
| KR | 2010/0112708 | | 10/2010 |
| KR | 2011/0079949 | | 7/2011 |
| WO | WO2006/120127 | | 11/2006 |
| WO | WO2008/133785 | | 11/2008 |
| WO | WO2011/101461 | | 8/2011 |
| WO | WO2012/031782 | | 3/2012 |
| WO | WO2012/162690 | | 11/2012 |
| WO | WO2014/048845 | | 4/2014 |
| WO | 2014203355 | A1 | 12/2014 |
| WO | WO2015/110443 | | 7/2015 |
| WO | WO2016/060777 | | 4/2016 |
| WO | WO2017/011123 | | 1/2017 |
| WO | WO2017/067871 | | 4/2017 |
| WO | 2018025533 | A1 | 2/2018 |

OTHER PUBLICATIONS

Chang, Ho-Myung et al, (2019) "Thermodynamic Design of Methane Liquefaction System Based on Reversed-Brayton Cycle" Cryogenics, pp. 226-234.

ConocoPhillips Liquefied Natural Gas Licensing (2017) "Our Technology and Expertise Are Ready to Work Toward Your LNG Future Today," http://lnglicensing.conocophillips.com/Documents/15-1106%20LNG%20Brochure_March2016.pdf, Apr. 25, 2017, 5 pgs.

Danish Technologies Institute (2017) "Project—Ice Bank System with Pulsating and Flexible Heat Exchanger (IPFLEX)," https://www.dti.dk/projects/project-ice-bank-system-with-pulsating-andflexible-heat-exchanger-ipflex/37176.

Diocee, T. S. et al. (2004) "Atlantic LNG Train 4—The Worlds Largest LNG Train", *The 14th International Conference and Exhibition on Liquefied Natural Gas* (*LNG* 14), Doha, Qatar, Mar. 21-24, 2004, 15 pgs.

Khoo, C. T. et al. (2009) "Execution of LNG Mega Trains—The Qatargas 2 Experience," *WCG*, 2009, 8 pages.

Laforte, C. et al. (2009) "Tensile, Torsional and Bending Strain at the Adhesive Rupture of an Iced Substrate," *ASME 28th Int'l Conf. on Ocean, Offshore and Arctic Eng*., OMAE2009-79458, 8 pgs.

McLachlan, Greg (2002) "Efficient Operation of LNG From the Oman LNG Project," *Shell Global Solutions International B.V*., Jan. 1, 2002, pp. 1-8.

Olsen, Lars et al. (2017).

Ott, C. M. et al. (2015) "Large LNG Trains: Technology Advances to Address Market Challenges", *Gastech*, Singapore, Oct. 27-30, 2015, 10 pgs.

Publication No. 43031 (2000) Research Disclosure, Mason Publications, Hampshire, GB, Feb. 1, 2000, p. 239, XP000969014, ISSN: 0374-4353, paragraphs [0004], [0005] & [0006].

Publication No. 37752 (1995) Research Disclosure, Mason Publications, Hampshire, GB, Sep. 1, 1995, p. 632, XP000536225, ISSN: 0374-4353, 1 page.

Ramshaw, Ian et al. (2009) "The Layout Challenges of Large Scale Floating LNG," *ConocoPhillips Global LNG Collaboration*, 2009, 24 pgs, XP009144486.

Riordan, Frank (1986) "A Deformable Heat Exchanger Separated by a Helicoid," *Journal of Physics A: Mathematical and General*, v. 19.9, pp. 1505-1515.

Roberts, M. J. et al. (2004) "Reducing LNG Capital Cost in Today's Competitive Environment", PS2-6, *The 14th International Conference and Exhibition on Liquefied Natural Gas* (*LNG* 14), Doha, Qatar, Mar. 21-24, 2004, 12 pgs.

Shah, Pankaj et al. (2013) "Refrigeration Compressor Driver Selection and Technology Qualification Enhances Value for the Wheatstone Project," *17th Int'l Conf. & Exh. on LNG*, 27 pgs.

Tan, Hongbo et al. (2016) "Proposal and Design of a Natural Gas Liquefaction Process Recovering the Energy Obtained from the Pressure Reducing Stations of High-Pressure Pipelines," *Cryogenics*, Elsevier, Kidlington, GB, v.80, Sep. 22, 2016, pp. 82-90.

Tianbiao, He et al. (2015), Optimal Synthesis of Expansion Liquefaction Cycle for Distributed-Scale LNG, *Institute of Refrigeration and Cryogenics, Shanghai Jiao Tong University*, pp. 268-280.

Tsang, T. P. et al. (2009) "Application of Novel Compressor/Driver Configuration in the Optimized Cascade Process," 2009 *Spring Mtg. and Global Conf. on Process Safety—9th Topical Conf. on Gas Utilization*, 2009, Abstract, 1 pg. https://www.aiche.org/conferences/aiche-spring-meeting-and-globalcongress-on-process-safety/2009/proceeding/paper/7a-application-novel-compressordriver-configurationoptimized-cascader-process.

Japanese Office Action from corresponding Japanese Application No. 2021-539530 dated Jan. 30, 2023.

* cited by examiner

LIQUEFACTION OF PRODUCTION GAS

CROSS REFERENCE TO RELATED APPLICATIONS

This application is a divisional of U.S. patent application Ser. No. 16/984,458, filed Aug. 4, 2020, which claims the priority benefit of United States Provisional Patent Application No. 62/893,422, filed Aug. 29, 2019, entitled LIQUEFACTION OF PRODUCTION GAS, the entirety of which is incorporated by reference herein.

FIELD

This disclosure relates generally to the field of hydrocarbon recovery, refinement, and/or reservoir management operations to enable production of subsurface hydrocarbons. Specifically, exemplary embodiments relate to methods and apparatus for liquefaction of production gas during liquefied natural gas (LNG) generation.

BACKGROUND

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Liquefied natural gas (LNG) is natural gas (predominantly methane, $CH_4$, with some mixture of heavier hydrocarbons, such as ethane, propane, and butanes, and possibly nonhydrocarbon contaminants, such as nitrogen, carbon dioxide, hydrogen sulfide, and water) that has been cooled to liquid form for ease and safety of storage and/or transport. Gas produced from hydrocarbon deposits may contain a wide range of hydrocarbon products (with a range of boiling points), "acidic" elements, such as hydrogen sulfide ($H_2S$) and carbon dioxide ($CO_2$), together with oil, mud, water, and mercury. The range of species within the gas is generally increased for gas which is co-produced with oil or hydrocarbon condensate. Such co-produced gas is commonly referred to as "associated gas." Associated gas is normally pre-treated to remove impurities (e.g., dust, acid gases, helium, water, and heavy hydrocarbons) and thereby generate a clean, sweetened stream of gas. The natural gas can be condensed into a liquid at close to ambient pressure by cooling the natural gas to approximately −162° C. Often, minimal processing and/or pre-treatment occurs at the well site, due at least in part to the complexities of installing and/or maintaining complex gas cleaning and refrigeration systems at remote locations, especially for small systems (e.g., <50 million standard cubic feet per day).

Conventional pre-treatment systems are large, power-intensive, and expensive. Conventional pre-treatment systems cannot be transported to remote production operations, but rather the associated gas must be transported from a well site to a refinement site for pre-treatment. Transportation of associated gas away from a well site (e.g., via pipelines) is not always practical and/or economic. Rather than transporting such gas to market or beneficially combusting the gas (e.g., for power generation), such gas may be flared. Flaring, although historically widely practiced, has been restricted in certain areas due to increased concern of lost resources and of environmental impact (e.g., $CO_2$ generation in the flared combustion gas). An alternative to flaring is to generate and store LNG on-site. However, the economics of small-scale LNG generation is generally marginal at best, especially if the associated gas has significant contamination from $CO_2$.

More efficient equipment and techniques to generate LNG from production gas would be beneficial, especially from associated gas which is contaminated with $CO_2$.

SUMMARY

Methods and apparatus for liquefying a feed gas stream comprising natural gas and carbon dioxide are discussed. In one or more embodiments disclosed herein, a method includes compressing an input fluid stream to generate a first intermediary fluid stream; cooling the first intermediary fluid stream with a first heat exchanger to generate a second intermediary fluid stream, wherein a temperature of the second intermediary fluid stream is higher than a carbon dioxide-freezing temperature for the second intermediary fluid stream; expanding the second intermediary fluid stream to generate a third intermediary fluid stream, wherein the third intermediary fluid stream comprises solid carbon dioxide; separating the third intermediary fluid stream into a fourth intermediary fluid stream and an output fluid stream, wherein the output fluid stream comprises a LNG liquid; and utilizing the fourth intermediary fluid stream as a cooling fluid stream for the first heat exchanger.

In one or more embodiments disclosed herein, a method includes: producing associated gas at a liquid hydrocarbon-producing well site; generating an LNG slurry at the well site from the associated gas, wherein generating the LNG slurry comprises: compressing an input fluid stream of the associated gas to generate a first intermediary fluid stream; cooling the first intermediary fluid stream with a first heat exchanger to generate a second intermediary fluid stream, wherein a temperature of the second intermediary fluid stream is higher than a carbon dioxide freezing temperature for the second intermediary fluid stream; expanding the second intermediary fluid stream to generate a third intermediary fluid stream, wherein the third intermediary fluid stream comprises solid carbon dioxide; and separating the LNG slurry from the third intermediary fluid stream; and transporting the LNG slurry away from the well site.

In one or more embodiments disclosed herein, a method includes: dehydrating the feed gas stream to generate a dehydrated feed gas stream; compressing the dehydrated feed gas stream to generate a compressed feed gas stream; cooling the compressed feed gas stream in a first heat exchanger to generate a first cooled feed gas stream, wherein: the first heat exchanger comprises a plurality of fluid streams, including: the compressed feed gas stream; a separated vapor stream;

a high-pressure, single mixed refrigerant stream; and a low-pressure, single mixed refrigerant stream, the low-pressure, single mixed refrigerant stream is formed in a closed refrigerant loop by reducing a pressure of the high-pressure, mixed refrigerant stream, and cooling the compressed feed gas stream results in formation of no frozen carbon dioxide in the first heat exchanger; cooling the first cooled feed gas stream in a second heat exchanger to generate a second cooled feed gas stream, wherein: the second heat exchanger comprises a plurality of fluid streams, including: the second cooled feed gas stream; and the separated vapor stream, and cooling the first cooled feed gas stream results in formation of no frozen carbon dioxide in the second heat exchanger; throttling the second cooled feed gas stream to form a partially-liquefied feed gas stream; separating the partially-liquefied feed gas stream to form:

the separated vapor stream; and a slurry of condensed feed gas and frozen carbon dioxide; and burning at least a portion of the separated vapor stream after it exits the first heat exchanger.

In one or more embodiments disclosed herein, a method includes: dehydrating the feed gas stream to generate a dehydrated feed gas stream; compressing the dehydrated feed gas stream to generate a compressed feed gas stream; cooling the compressed feed gas stream in a first heat exchanger to generate a first cooled feed gas stream, wherein: the first heat exchanger comprises a plurality of fluid streams, including: the compressed feed gas stream; a high-pressure, separated vapor stream; a high-pressure, single mixed refrigerant stream; and a low-pressure, single mixed refrigerant stream, the low-pressure, single mixed refrigerant stream is formed in a closed refrigerant loop by reducing a pressure of the high-pressure, mixed refrigerant stream, and cooling the compressed feed gas stream results in formation of no frozen carbon dioxide in the first heat exchanger; cooling the first cooled feed gas stream in a second heat exchanger to generate a second cooled feed gas stream, wherein: the second heat exchanger comprises a plurality of fluid streams, including: the second cooled feed gas stream; the high-pressure, separated vapor stream; and a low pressure, separated vapor stream, and cooling the first cooled feed gas stream results in formation of no frozen carbon dioxide in the second heat exchanger;

throttling the second cooled feed gas stream to form a first partially-liquefied feed gas stream; separating the first partially-liquefied feed gas stream to form: the low-pressure, separated vapor stream; and a first slurry of condensed feed gas and frozen carbon dioxide; compressing the low-pressure, separated vapor stream to form the high-pressure, separated vapor stream; throttling the high-pressure, separated vapor stream to form a second partially-liquefied feed gas stream; combining the first partially-liquefied feed gas stream with the second partially-liquefied feed gas stream to form a combined, partially-liquefied feed gas stream; and separating the combined, partially-liquefied feed gas stream to form: an output vapor stream; and an output liquid slurry of condensed feed gas and frozen carbon dioxide.

In one or more embodiments disclosed herein, a method includes: dehydrating the feed gas stream to generate a dehydrated feed gas stream; compressing the dehydrated feed gas stream to generate a compressed feed gas stream; cooling the compressed feed gas stream in a first heat exchanger to generate a first cooled feed gas stream, wherein: the first heat exchanger comprises a plurality of fluid streams, including: the compressed feed gas stream; a high-pressure, nitrogen coolant stream; and a low-pressure, nitrogen coolant stream, and cooling the compressed feed gas stream results in formation of no frozen carbon dioxide in the first heat exchanger; expanding the high-pressure, nitrogen coolant stream through a turboexpander to form the low-pressure, nitrogen coolant stream and to generate a first unit of power, wherein at least portion of the first unit of power is utilized during the compressing the dehydrated feed gas stream; throttling the first cooled feed gas stream to form a first partially-liquefied feed gas stream; separating the first partially-liquefied feed gas stream to form: a low-pressure, separated vapor stream; and a first slurry of condensed feed gas and frozen carbon dioxide; compressing the low-pressure, separated vapor stream to form a high-pressure, separated vapor stream; cooling the high-pressure, separated vapor stream in a second heat exchanger to generate a liquefied feed gas stream, wherein: the second heat exchanger comprises a plurality of fluid streams, including: the high-pressure, separated vapor stream; and a pressurized liquid nitrogen stream, upon exiting the second heat exchanger, the pressurized liquid nitrogen stream becomes the high-pressure, nitrogen coolant stream, and the pressurized liquid nitrogen stream is formed by: transporting liquid nitrogen to the site; and compressing the transported liquid nitrogen; combining the liquefied feed gas stream with the first slurry to form a combined, liquefied feed gas stream; throttling the combined, liquefied feed gas stream to form a second partially-liquefied feed gas stream; and separating the second partially-liquefied feed gas stream to form: an output vapor stream; and an output slurry of condensed feed gas and frozen carbon dioxide.

BRIEF DESCRIPTION OF THE DRAWINGS

So that the manner in which the recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of scope, for the disclosure may admit to other equally effective embodiments and applications.

DETAILED DESCRIPTION

Figure 1:
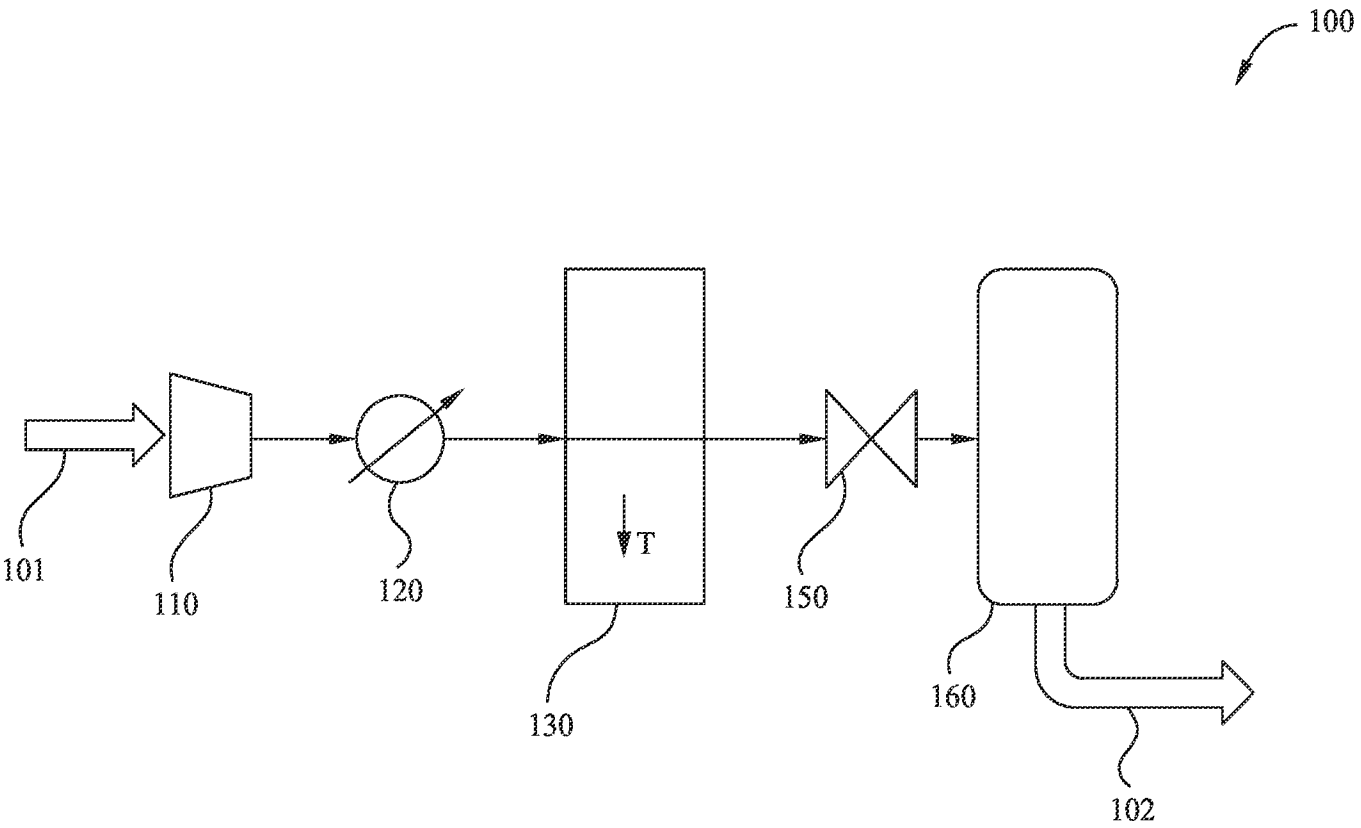
FIG. 1 illustrates an exemplary method of liquefied natural gas (LNG) generation according to embodiments disclosed herein.

It is to be understood that the present disclosure is not limited to particular devices or methods, which may, of course, vary. It is also to be understood that the terminology used herein is for the purpose of describing particular embodiments only, and is not intended to be limiting. As used herein, the singular forms "a," "an," and "the" include singular and plural referents unless the content clearly dictates otherwise. Furthermore, the words "can" and "may" are used throughout this application in a permissive sense (i.e., having the potential to, being able to), not in a mandatory sense (i.e., must). The term "include," and derivations thereof, mean "including, but not limited to." The term "coupled" means directly or indirectly connected. The word "exemplary" is used herein to mean "serving as an example, instance, or illustration." Any aspect described herein as "exemplary" is not necessarily to be construed as preferred or advantageous over other aspects. The term "uniform" means substantially equal for each sub-element, within about ±10% variation.

The term "real time" generally refers to the time delay resulting from detecting, sensing, collecting, filtering, amplifying, modulating, processing, and/or transmitting relevant data or attributes from one point (e.g., an event detection/sensing location) to another (e.g., a data monitoring location). In some situations, a time delay from detection of a physical event to observance of the data representing the physical event is insignificant or imperceptible, such that real time approximates instantaneous action. Real time may also refer to longer time delays that are still short enough to allow timely use of the data to monitor, control, adjust, or otherwise impact subsequent detections of such physical events.

As used herein, a "well site" is an onshore or offshore location where at least one well connects a subsurface reservoir (e.g., containing fluids) to the surface, and the region around the well(s), including any associated physical pad or structure (e.g., foundation) to support activities and equipment directly related to the operation of the well(s). The size of a well site is typically ½ to 2 acres, but may be larger depending on the number of wells at the site (e.g., sharing equipment), vehicle access issues, and safety concerns about placing equipment close together. Large well sites may be 3 or even 5 acres in size.

If there is any conflict in the usages of a word or term in this specification and one or more patent or other documents that may be incorporated herein by reference, the definitions that are consistent with this specification should be adopted for the purposes of understanding this disclosure.

One of the many potential advantages of the embodiments of the present disclosure is improved efficiency in the generation of LNG from production gas by reducing or eliminating pre-treatment processes (e.g., removal of natural gas liquids and/or solid-forming species, especially $CO_2$). Other potential advantages include one or more of the following, among others that will be apparent to the skilled artisan with the benefit of this disclosure: gas handling costs may be reduced; gas handling costs may be significantly reduced for associated gas; gas handling procedures may be simplified at areas without ready access to pipelines; flaring procedures may be reduced or eliminated, especially for small developments, by enabling transportation of LNG liquid and/or LNG slurry away from the well site (e.g., via trucking, rail, and/or ships). In some embodiments, potential advantages include (at least partial) liquefaction of natural gas at or near a well site, thereby reducing transportation costs. Embodiments of the present disclosure can thereby be useful in the processing of hydrocarbons from subsurface formations or treating of combustion flue gases to capture and reduce $CO_2$ emissions.

Methods and apparatus for LNG generation disclosed herein utilize one or more heat exchangers. Commonly, a heat exchanger transfers heat from a higher-temperature fluid (e.g., a process fluid) to a lower-temperature fluid (e.g., a cooling fluid), thereby reducing the temperature of the higher-temperature fluid and/or raising the temperature of the cooling fluid. Heat exchangers may utilize multiple fluid streams, with the temperature of any one fluid stream being affected by the temperatures of each of the other fluid streams. At times, reduction in temperature of a fluid stream by the action of the heat exchanger will result in freezing, solidifying, and/or precipitation of one or more components of the process fluid stream. In some embodiments, a heat exchanger may be selected with features that facilitate removal of such frozen components.

FIG. 1 illustrates an exemplary method 100 of LNG generation according to embodiments disclosed herein. Method 100 takes as input a fluid stream 101, which may be a stream of dehydrated production gas. In some embodiments, input fluid stream 101 is an associated gas produced in conjunction with liquid hydrocarbon recovery at a well site. In some embodiments, input fluid stream 101 has high concentrations of $C_{2+}$ components (e.g., heavy hydrocarbons). For example, input fluid stream 101 may be rich in $C_{2+}$ components and include $CO_2$. In some embodiments, the input fluid stream 101 comprises between about 0.65 and about 0.85 mole fraction methane on a $CO_2$-free and water free-basis. In some embodiments, the input fluid stream 101 comprises at least about 0.15 mole fraction $C_{2+}$ hydrocarbons on a $CO_2$-free and water free-basis. In some embodiments the input fluid stream 101 has a $CO_2$ concentration of about 0.1 mol % to about 10 mol %. It is currently believed that method 100 may be more effective with input fluid streams with higher condensation temperatures, and thus more applicable to input fluid streams that include heavy components, rather than input fluid streams with very high methane concentrations (e.g., greater than about 90 mol %). Method 100 produces as output a fluid stream 102, which may be a LNG liquid and/or a LNG slurry of LNG liquid and frozen species such as $CO_2$. Method 100 includes several processing steps that are performed in the illustrated order to effect a conversion of at least a portion of input fluid stream 101 into output fluid stream 102. It should be understood that, in each of the illustrated embodiments unless otherwise specified, intermediary fluid streams transfer from one processing step to the next, and that at each processing step, in addition to the intermediary fluid stream, there may be one or more co-feeds as input (not shown) and/or one or more by-products as output (not shown). More specifically, it should be understood that solid $CO_2$ may be a by-product of one or more processing steps (e.g., reduction of temperature at a heat exchanger, reduction of pressure at a throttle), and solid $CO_2$ by-product may be retained in, and/or removed from, the intermediary fluid stream at any such processing step.

As illustrated in FIG. 1, a first processing step of method 100 reduces the volume and increases the pressure of the input fluid stream 101 at compressor 110. A next processing step of method 100 reduces the temperature of the intermediary fluid stream at cooler 120. In some embodiments cooler 120 may be a cooler using ambient air or water as the coolant. A next processing step of method 100 further reduces the temperature of the intermediary fluid stream at heat exchanger 130. Note that one or more cooling fluid streams (not shown) may flow through heat exchanger 130 to reduce the temperature of the intermediary fluid stream. The temperature of the intermediary fluid stream at heat exchanger 130 may be reduced to a temperature at which $CO_2$ within the intermediary fluid stream does not freeze. For example, the temperature of the intermediary fluid stream at heat exchanger 130 may be reduced to, or just above, a $CO_2$ freezing temperature (e.g., within 10° C. of the $CO_2$ freezing temperature, which depends on the concentration of the $CO_2$ in the intermediary fluid stream). In some embodiments, the temperature of the intermediary fluid stream at heat exchanger 130 may be reduced to about −95° C. to about −120° C., or more particularly about −102° C. for an intermediary fluid stream with about 5 to about 10 mol % $CO_2$. It is currently believed that operation of a heat exchanger (e.g., heat exchanger 130) at or above $CO_2$ freezing temperature may improve efficiency of the heat exchanger and/or prevent damage or degradation, for example by reducing the risk of narrowing and/or clogging of processing fluid channels. A next processing step of method 100 reduces the pressure of the intermediary fluid stream at throttle 150. Note that the reduction in pressure at throttle 150 results in a further reduction of temperature of the intermediary fluid stream (e.g., depending on the composition of the intermediary fluid stream and the inlet pressure of the throttle, about −160° C. to about −150° C.). For example, the throttle 150 may reduce the pressure of the intermediary fluid stream to ambient or near-ambient pressure. In some embodiments, the throttle 150 may reduce the pressure to an elevated pressure (e.g., >150 kPa or >300 kPa). In some embodiments, the further reduction of temperature at throttle 150 may result in production of solid $CO_2$ by-product. A next processing step of method 100 separates a primarily-liquid component (e.g., a LNG liquid and/or a LNG slurry of LNG liquid and frozen $CO_2$) of the intermediary fluid stream at a separation tank 160, thereby producing as output a fluid stream 102.

In some embodiments, input fluid stream 101 is generated from a production gas feed by separating out liquid-forming species (e.g., $C_{6+}$ components) via conventional methods (e.g., in an oil-gas or oil-gas-water separator to form a liquid phase that is primarily stable at ambient conditions). The gas feed may be then dehydrated (e.g., dehydration with mild cooling under pressure, glycol contacting, molecular sieves, and/or solid adsorbents) to reduce the water content. For example, the water content may be sufficiently reduced such that water-ice or hydrates will not form when the gas stream is transferred to one or more subsequent heat exchangers (e.g., heat exchangers utilized in any method of LNG generation according to embodiments disclosed herein).

In some embodiments, input fluid stream 101 is an associated gas that has been co-produced with oil or other hydrocarbons from a subsurface well. Associated gas tends to be rich in $C_{2+}$ components, since the gas is in phase equilibrium with the oil. Whereas methane-rich natural gas (such as may occur in non-associated gas reservoirs) may have a specific gravity (relative to air) of about 0.60, associated gas tends to have a specific gravity in a range of about 0.70 to about 0.85. In some embodiments, input fluid stream 101 has a specific gravity greater or equal to about 0.75. It should be appreciated that the energy utilized to liquefy an associated gas that is rich in $C_{2+}$ components may be considerably less than the energy utilized to liquefy a natural gas with little $C_{2+}$ components.

In some embodiments, the reduction in temperature of the intermediary fluid stream in the heat exchanger 130 is controlled to mitigate formation of solids in the heat exchanger 130. It should be appreciated that solid formation may be of particular concern if a substantial concentration of $CO_2$ is present in the intermediary fluid stream. For example, the temperature of the intermediary fluid stream in the heat exchanger 130 may be maintained in a range of from about −95° C. to about −120° C., or more specifically from about −100° C. to about −115° C. for $CO_2$ concentrations of up to several mole percent.

Figure 2A:
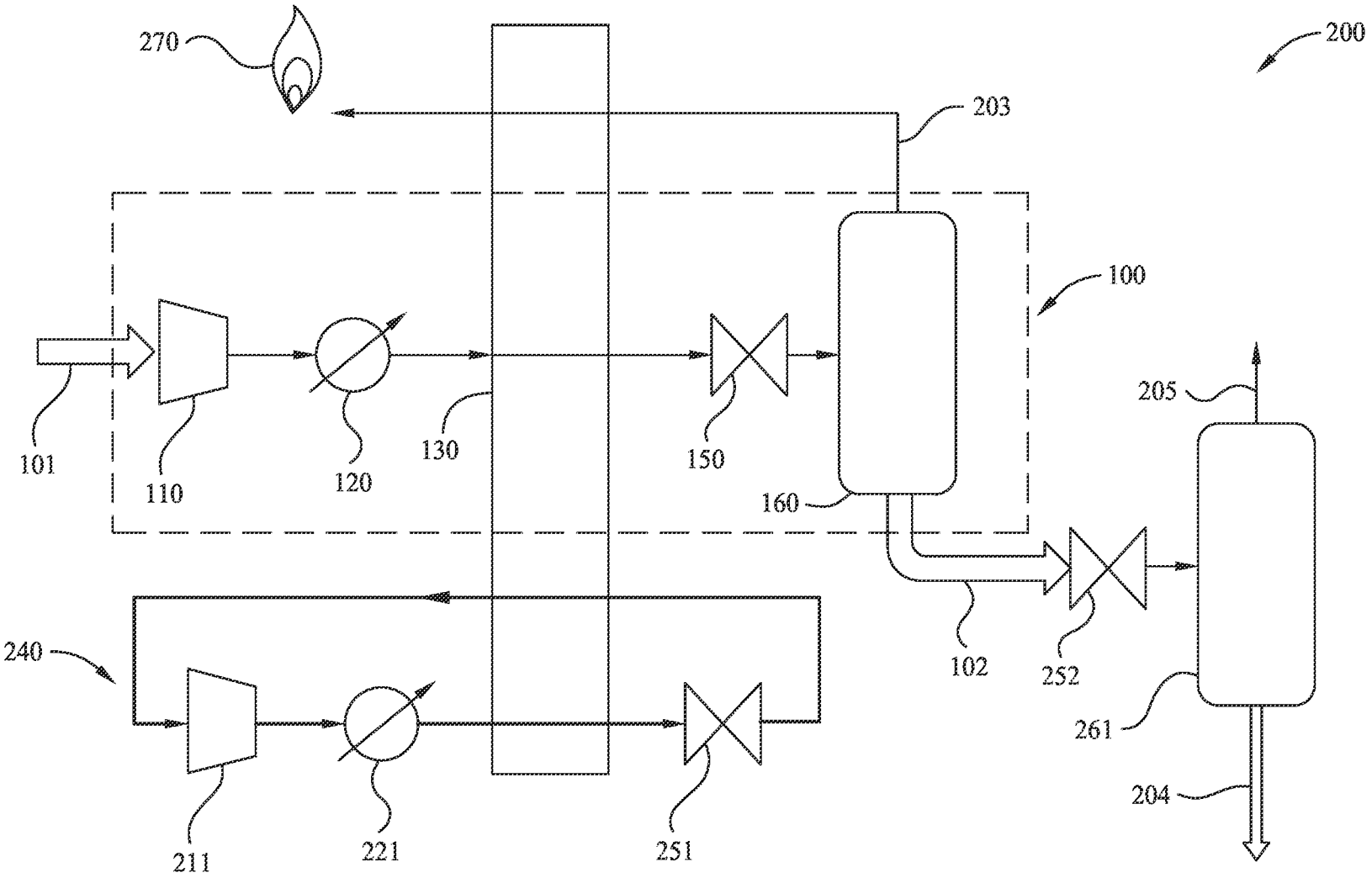
FIG. 2A illustrates an exemplary partial-liquefaction method of LNG generation according to embodiments disclosed herein.

FIG. 2A illustrates another exemplary method 200 of LNG generation according to embodiments disclosed herein. Method 200 augments method 100 with one or more enhancement processes. For example, method 200 may augment method 100 by the addition of a mixed refrigerant loop 240. Mixed refrigerants (e.g., a refrigerant composed of two or more species, including, but not limited to, methane, ethane, propane, i-butane and nitrogen) may be used in a mixed refrigerant loop 240. Alternatively, a pure nitrogen refrigerant loop may be employed. In some embodiments the mixed refrigerant has a composition of greater than about 0.50 mol frac of the sum of the mol frac of nitrogen+methane+$C_2$ hydrocarbons and greater than about 0.20 mol frac of $C_{4+}$ hydrocarbons. As illustrated, mixed refrigerant loop 240 provides two cooling fluid streams for heat exchanger 130. Mixed refrigerant loop 240 includes, for example, a compressor 211, a cooler 221, and a throttle 251. As illustrated, the fluid stream of mixed refrigerant loop 240 may sequentially transfer from compressor 211 to cooler 221, then from cooler 221 to heat exchanger 130 (first cooling fluid stream), then from heat exchanger 130 to throttle 251, then from throttle 251 to heat exchanger 130 (second cooling fluid stream), and then from heat exchanger 130 back to compressor 211.

As another example, method 200 may augment method 100 by the extraction of a fluid stream 203 (e.g., a primarily-gaseous fluid stream) produced at separation tank 160. As illustrated, fluid stream 203 may be used as a cooling fluid stream for heat exchanger 130 before being consumed at burner 270. For example, fluid stream 203 may exit separation tank 160 and/or enter heat exchanger 130 at a temperature of about −160° C. (at ambient pressure). It should be understood that fluid stream 203 may be significantly depleted of $C_{2+}$ components, due at least in part, to the higher $C_{2+}$ condensation temperatures than the methane condensation temperature. In some embodiments, burner 270 is a flaring device. In some embodiments, burner 270 utilizes fluid stream 203 as fuel, such as in a boiler or a combustion engine. In some embodiments, about 20 mass % to about 30 mass % of the input fluid stream 101 may be extracted in fluid stream 203, while about 70 mass % to about 80 mass % of the input fluid stream 101 may be extracted in fluid stream 102 (e.g., as a near-ambient pressure LNG liquid and/or a LNG slurry of LNG liquid and frozen $CO_2$). Consequently, method 200 may be referred to as a "partial-liquefaction method." Compared to conventional methods, partial-liquefaction methods may beneficially reduce the amount of gas being flared (e.g., about 75% liquefied, with about 25% flared), and/or may beneficially capture the majority of the valuable $C_{2+}$ species of the input fluid stream 101. Consuming non-liquefied gas at burner 270 may be useful, for example, for (at least partial) liquefaction of natural gas at or near a well site. Compared to other methods discussed below, a partial-liquefaction method may provide a simplified process that does not utilize recompression of the non-liquefied gas. For example, for an input fluid stream having a specific gravity of about 0.8 and a $CO_2$ concentration of about 2 mol %, an output fluid stream may contain liquefied LNG of about 75 mass % of the input fluid stream.

Partial-liquefaction methods as disclosed herein may convert an associated gas to LNG with reduced pre-treating. For example, pre-treating the associated gas may include dehydration, but the pre-treating may include no, or minimal, $CO_2$ reduction. While the non-liquefied portion of the gas (e.g., fluid stream 203) may be flared, the non-liquefied gas may have minimal $C_{2+}$ components, since those components strongly partition into the liquid phase at LNG temperatures (e.g., about −160° C. at atmospheric pressure). Since the non-liquefied gas is primarily methane (and any nitrogen in the gas), $CO_2$ generation is minimized in the flare as compared to flaring an equal volume of a C2+ rich gas. Moreover, destruction of fuel value is also minimized since methane has the lowest energy-per-standard-volume of species solely composed of hydrogen and carbon. Furthermore, since liquefaction of methane is an extremely energy-intensive process (due to its low boiling point), purposely and selectively rejecting a portion of the methane significantly reduces the refrigeration power for liquefaction.

Figure 2B:
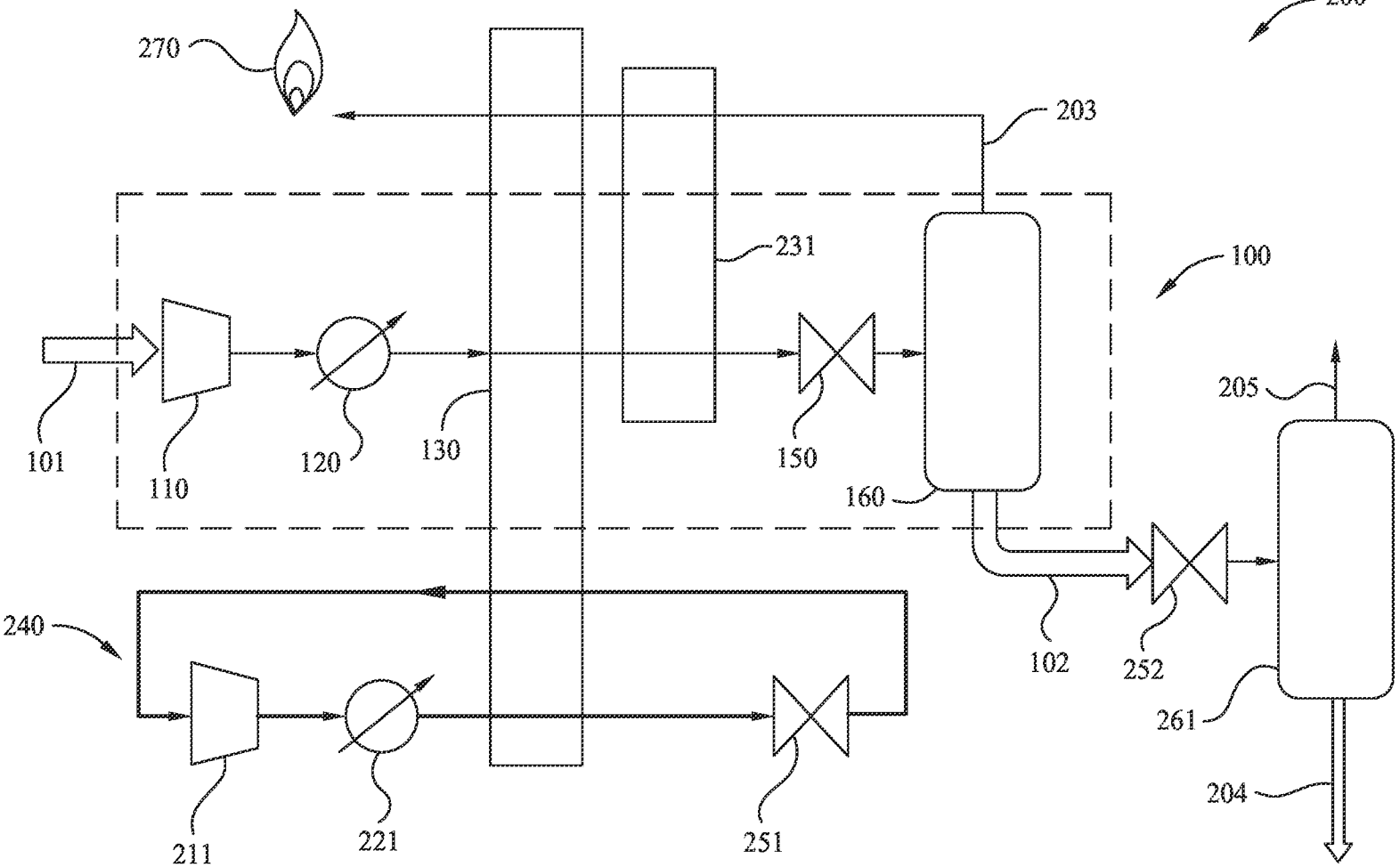
FIG. 2B illustrates an exemplary augmentation of the method of FIG. 2A.

In some embodiments, method 200 may be further augmented to provide more efficient partial-liquefaction methods. For example, as illustrated in FIG. 2B, a secondary heat exchanger 231 may operate to optimize, or at least enhance, the use of the fluid stream 203 to further cool the intermediary fluid stream (of method 100) after cooling at heat exchanger 130 and prior to expansion at throttle 150. Note that secondary heat exchanger 231 may be configured to maintain a temperature of the intermediary fluid stream above a freezing temperature for $CO_2$ in the intermediary fluid stream. For example, the intermediary fluid stream may enter the secondary heat exchanger 231 with a temperature near −110° C. and exit with a temperature near −120° C., while fluid stream 203 may enter the secondary heat exchanger 231 with a temperature near −160° C. and exit with a temperature near −130° C. (before entering the heat exchanger 130). This secondary heat exchanger 231, in this temperature-staged arrangement downstream of heat exchanger 130, may more efficiently use the cooling ability of the fluid stream 203, since the refrigeration system is allowed to provide cooling at a higher temperature. The secondary heat exchanger 231 allows cooling of the intermediary fluid stream to lower temperature than the refrigeration system cooling with fluid stream 203 alone.

As another example, method 200 may augment method 100 by the addition of a secondary throttle 252 and secondary separation tank 261. For example, if the reduction in pressure at throttle 150 results in an intermediary fluid stream at an elevated pressure (e.g., greater than ambient pressure), output fluid stream 102 may be further decompressed at throttle 252. A next processing step of method 200 may separate a primarily-liquid component (e.g., a LNG liquid and/or a LNG slurry of LNG liquid and frozen $CO_2$) of the further-decompressed intermediary fluid stream at secondary separation tank 261, thereby producing as output fluid stream 204. An additional fluid stream 205 (e.g., a primarily-gaseous fluid stream) may be produced at secondary separation tank 261. Method 200 may include, for example, burning fluid stream 205 as a low-pressure flare and/or as fuel (e.g., at burner 270 or similar).

In some embodiments (e.g., as an alternative to secondary throttle 252 and secondary separation tank 261), a LNG slurry of LNG liquid and frozen $CO_2$ (e.g., output fluid stream 102, output fluid stream 204) may be transported, rather than separated at the well site. Transporting a LNG slurry (e.g., an unseparated LNG slurry) may reduce the overall complexity of the system. The LNG slurry may be transported to a central processing plant for separation and/or $CO_2$ capture. In some embodiments, the LNG slurry may be maintained at an elevated pressure during transportation. Not expanding the LNG slurry to ambient pressure before transporting may result in increased recovery of gas in liquid form (e.g., at the central processing plant), although at the added expense of pressurized storage and transport. Transporting a LNG slurry may be useful, for example, for (at least partial) liquefaction of natural gas at or near a well site.

In some embodiments, solid $CO_2$ may be extracted from the LNG slurry prior to transporting. For example, LNG liquid may be drawn from a holding tank (e.g., separation tank 261), leaving solid $CO_2$ residue, and/or the LNG slurry may be passed through filters (e.g., liquid & gas filters, strainers, fully automatic backflush filters, filter separators, coalescers, cyclones, carbon bed filters & cartridge filters). In some embodiments, extracted $CO_2$ solids may be desublimed via heating and vented.

In some embodiments, a control system may be used to monitor and/or maintain temperatures and/or pressures of the various fluid streams. For example, a control system may monitor and/or maintain a pre-throttle temperature (e.g., any intermediary fluid stream prior to throttle 150) above, but close to, the $CO_2$ freeze-out temperature (e.g., from about −120° C. to about −95° C.). Note that the $CO_2$ freeze-out temperature may vary depending on the composition of input fluid stream 101. This may be particularly important for application to associated gas, since the flow rate and/or composition typically changes with time due to decreasing pressure in an oil-producing well. The pre-throttle temperature may be maintained to ensure $CO_2$ freeze-out does not occur in the heat exchanger, possibly resulting in blockages thereof. Moreover, the pre-throttle temperature may be maintained with variation of the flow rate and/or composition of input fluid stream 101.

Figure 3:
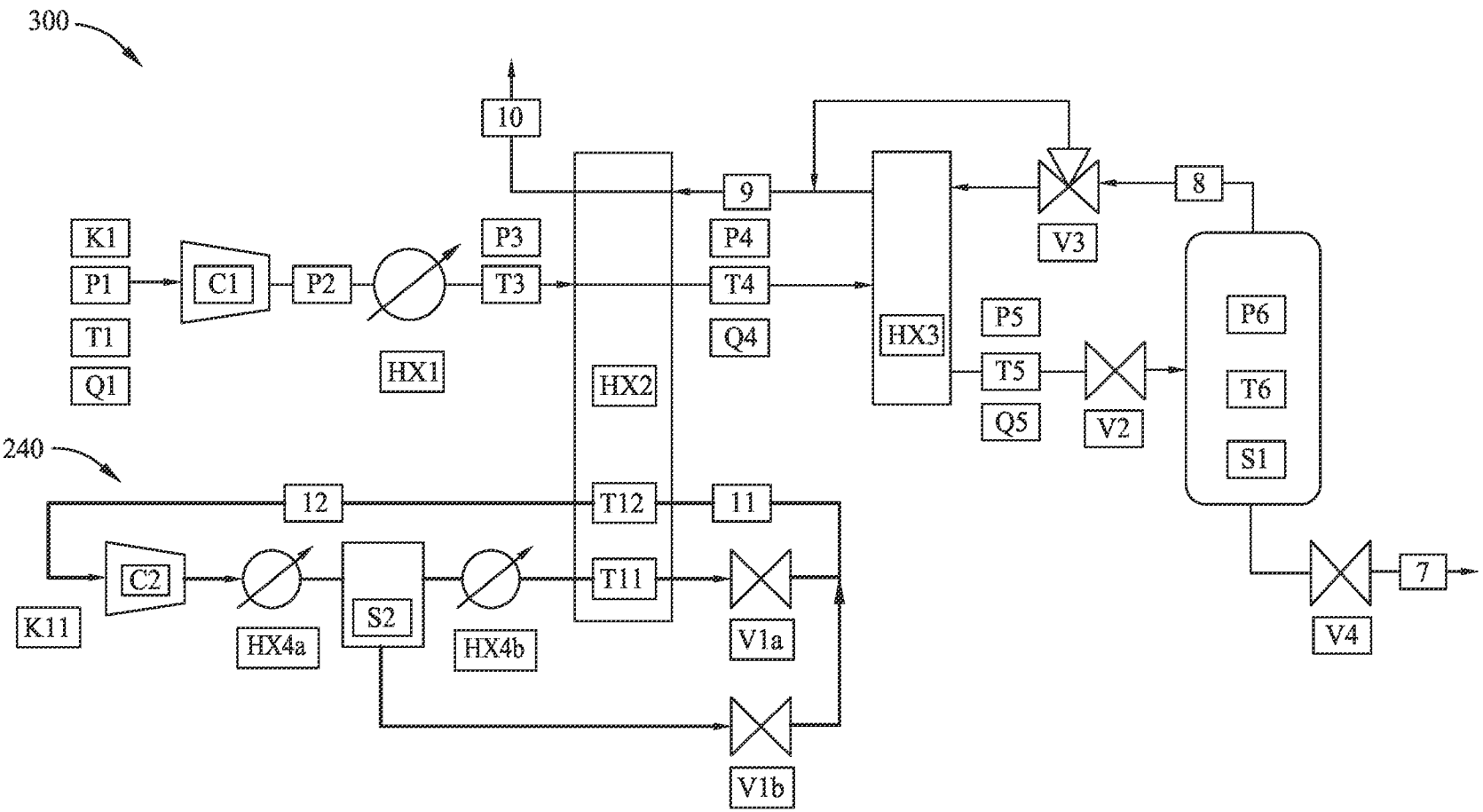
FIG. 3 illustrates another exemplary partial-liquefaction method of LNG generation according to embodiments disclosed herein.

FIG. 3 illustrates another exemplary method 300 of partial-liquefaction LNG generation according to embodiments disclosed herein. Method 300 illustrates exemplary uses of a control system with any of the methods disclosed herein. The symbols and numerals of FIG. 3 should be read as:

| Symbol | Fluid property or component |
|---|---|
| K: | Composition |
| Q: | Fluid flow rate |
| P: | Pressure |
| T: | Temperature |
| C: | Compressor |
| HX: | Heat exchanger (or cooler) |
| V: | Throttle (or valve) |
| S: | Separation tank |
| n: | Fluid stream or component identifier |

For example, a pressure measurement of intermediary fluid stream 2 may be indicated as P2. Pressure P2 may be monitored and used in combination with input fluid stream composition K1 (which may also be monitored) as input to a thermodynamic model. Over time, as composition K1 varies, the model may predict the onset of $CO_2$ precipitation and/or provide a minimum-allowable intermediary fluid stream temperature T4 and/or temperature T5 to avoid $CO_2$ precipitation within heat exchanger HX2 and/or heat exchanger HX3. The control system may adjust operating parameters for cooler HX1, heat exchanger HX2, and/or heat exchanger HX3 based on the model. A simple, "reduced order" model may be integrated in the control system to predict (e.g., continuously, periodically, or intermittently) the precipitation temperature at the given pressure.

As another example, the pressure drop (e.g., pressure P4−pressure P3) of heat exchanger HX2 may be monitored in combination with real-time flow rate data (e.g., flow rate Q3, flow rate Q4) to detect solid formation in the heat exchanger HX2. Similar measurements and calculations may be made for heat exchanger HX3. This may be in addition to, or in lieu of, the thermodynamic model to ensure detection and/or reduction of solids build-up in the heat exchangers.

As another example, the flow of intermediary fluid stream 8 may be monitored and/or controlled at three-way bypass valve V3. Since intermediary fluid stream 8 acts as a cooling fluid stream for heat exchanger HX3, controlling the fluid flow of intermediary fluid stream 8 through heat exchanger HX3 thereby provides control of temperature T5. Maintaining temperature T5 above $CO_2$ freezing temperature may mitigate risk of solid build up in heat exchanger HX3.

As another example, the flow of refrigerant fluid stream 11 in mixed refrigerant loop 240 may be monitored and/or controlled at compressor C2. The compressor speed and/or inlet guide vanes may be used for suction-pressure control. Suction-pressure manipulation of compressor C2 may actively control temperature T11, the temperature of the refrigerant fluid stream 11 in heat exchanger HX2. Since refrigerant fluid stream 11 acts as a cooling fluid stream for heat exchanger HX2, controlling the suction pressure of compressor C2 controls the flow of refrigerant fluid stream 11 through heat exchanger HX2, and thereby provides control of temperature T4. Maintaining temperature T4 above $CO_2$ freezing temperature may mitigate risk of solid build-up in heat exchanger HX2.

As another example, the flow of refrigerant fluid stream 11 may be monitored and/or controlled at refrigerant throttle valve Vla. Modulating the refrigerant throttle valve V1*a* may achieve a superheat temperature T12 in the refrigerant fluid stream 12, and may thereby optimize, or at least increase, refrigerant utilization. For example, by modulating the refrigerant throttle valve V1*a* to control the temperature T12, a selected amount of refrigerant may be evaporated during the cooling process in heat exchanger HX2. For a lower cooling specification, a reduced superheat temperature may be selected, and not all of the refrigerant may be evaporated. As a result, throttling of V1*a* may reduce flow of refrigerant fluid stream 11 to restore superheat temperatures of the refrigerant. This may ultimately result in reduced refrigerant flow in the compressor C2. This may also ultimately result in lower energy consumption of the refrigerant loop. This may also prevent damage to the compressor C2 due to liquid refrigerant.

As another example, temperature T5 may be at least partially controlled by varying a speed of compressor C1. For example, a flow rate Q1 of input fluid stream 1 may be monitored. A speed of compressor C1 may be varied in response to changes in the flow rate Q1 to maintain a desired temperature T5.

As another example, the composition K11 of the refrigerant fluid in mixed refrigerant loop 240 may be adjusted to affect cooling capacity for heat exchanger HX2. For example, a separation tank S2 may be utilized to separate liquid and solid components of the refrigerant fluid. When the refrigerant fluid partially liquefies, the heavier components preferentially condense in separation tank S2. A liquid-level control of separation tank S2 may be utilized to adjust the composition of the refrigerant fluid. Adjusting the composition may in turn affect the cooling capacity of the mixed refrigerant loop 240. This may allow for active control in response to change in production rates and/or flow rate Q1 of input fluid stream 1.

Further, pressure P2 may be actively controlled with compressor C1. For example, active control of pressure P2 may manipulate pressure P5 to affect the pressure drop across throttle valve V2 and, therefore, temperature T6. Thus, the temperature condition of the refrigeration system (e.g., mixed refrigerant loop 240 and heat exchanger HX2) to achieve a certain temperature T4 can be relaxed if a higher pressure P5 is attainable. Active control of pressure P5 can therefore be used to optimize, or at least enhance overall energy consumption of the liquefaction process. Active control of pressure P2 to a fixed set-point may also ensure consistent operation while inlet gas pressure P1 may vary.

In some embodiments, the control system may be operated on an ongoing basis. For example, an automated process may cause the measurements to be collected and/or the model(s) to be updated at regular intervals (e.g., hourly, several times per day, daily, etc.). In some embodiments, the control system may collect measurements and/or update model(s) with a certain frequency during standard operations, and the control system may collect measurements and/or update model(s) with a higher frequency during exceptional operations. For example, a trigger (e.g., a data threshold indicative of an unplanned occurrence) may switch the control system from standard-monitoring frequency (e.g., hourly, several times per day, daily, etc.) to exception-monitoring frequency (e.g., every second, every minute, every five minutes, every half hour, etc.). In some embodiments, a function of the control system under exceptional operations may be to preserve records (e.g., making backup copies of existing data, transmitting data to remote locations, creating duplicative data records, and/or storing existing records to avoid overwriting data). In some embodiments, the control system may collect measurements on an ad hoc basis. For example, an operator may request updated data, and the control system may collect one or more types of measurements in response to the request. As another example, a trigger (e.g., a data threshold indicative of an unplanned occurrence) may cause the control system to collect one or more measurements.

Figure 4A:
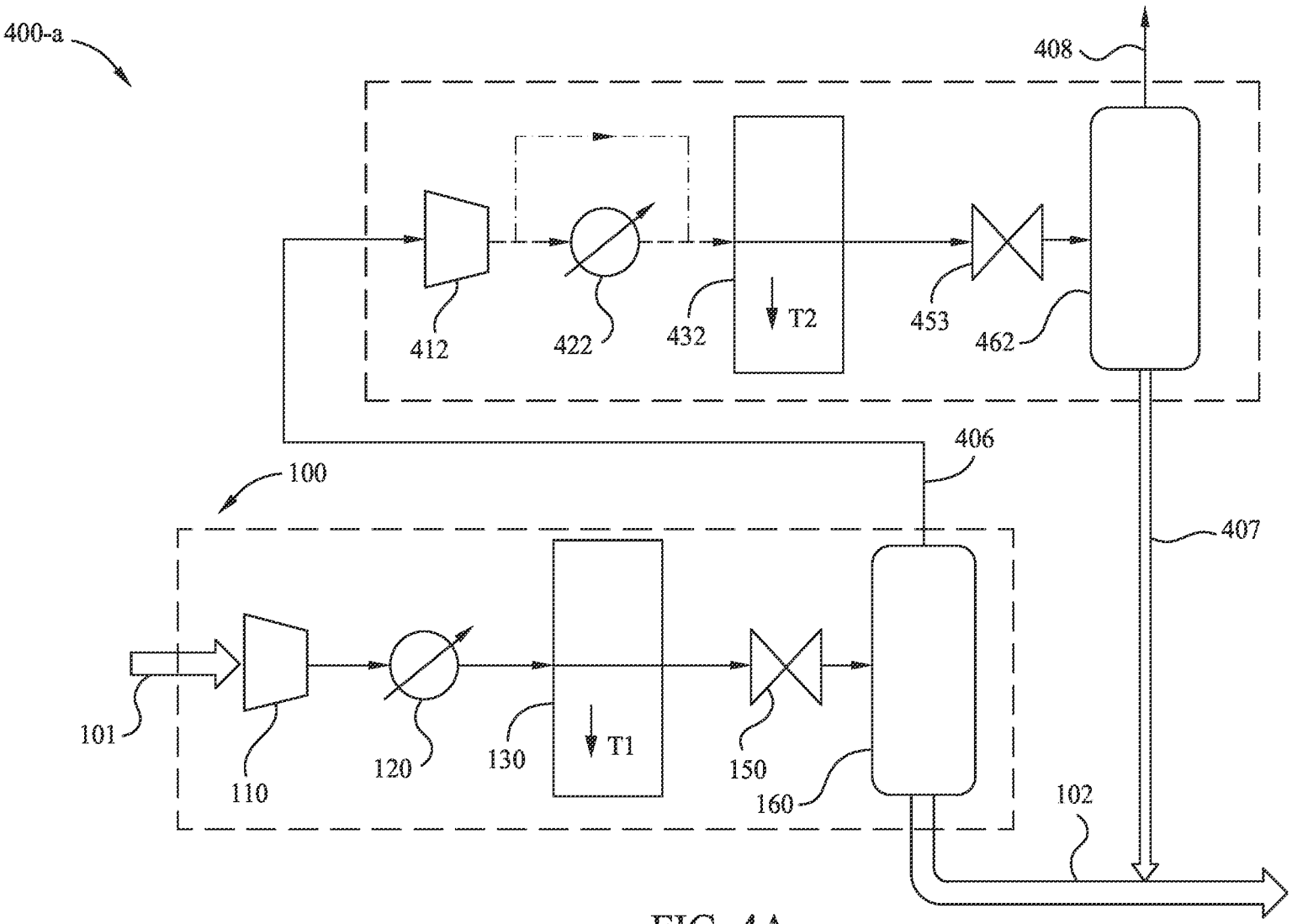
FIG. 4A illustrates an exemplary near-full-liquefaction method of LNG generation according to embodiments disclosed herein.

In some embodiments, the reduction in pressure at throttle 150 (in FIG. 1, FIG. 2A, or FIG. 2B) may result in the formation of solids (e.g., solid $CO_2$, water ice, hydrates), thus forming an LNG slurry. The fraction of gas which is not condensed through the throttle 150 (e.g., fluid stream 203) may be re-compressed and re-cooled to form an additional LNG slurry. For example, FIG. 4A illustrates another exemplary method 400-*a* of LNG generation according to embodiments disclosed herein. Method 400-*a* augments method 100 with one or more enhancement processes (e.g., additional, sequential processing according to method 100 with a secondary heat exchanger). Method 400-*a* may augment method 100 by the extraction, re-compression, and re-cooling of fluid stream 406 (e.g., a primarily-gaseous fluid stream) from separation tank 160. As illustrated, fluid stream 406 is extracted from separation tank 160 as the fraction of gas which is not condensed through the throttle 150. Method 400-*a* includes a processing step of reducing the volume of the fluid stream 406 at a secondary compressor 412. A next, optional processing step of method 400-*a* reduces the temperature of the intermediary fluid stream at cooler 422. A next processing step of method 400-*a* reduces the temperature of the intermediary fluid stream at a secondary heat exchanger 432. Note that, if $CO_2$ is present in fluid stream 406, the re-cooling of the intermediary fluid stream at secondary heat exchanger 432 may be performed to a temperature T2 that is lower than the temperature T1 of the intermediary fluid stream in heat exchanger 130. The lower re-cooling temperature may be possible since much of the $CO_2$ in the intermediary fluid stream would have solidified or condensed-out during the first decompression at throttle 150, thus reducing the freezing temperature of fluid stream 406. (Note that method 400-*a* may optionally utilize one or more cooling fluid streams of one or more mixed refrigerant loops (e.g., mixed refrigerant loop 240 of FIGS. 2A and 2B) with the heat exchanger 130 to achieve temperature T1.) A next processing step of method 400-*a* reduces the pressure of the intermediary fluid stream at a secondary throttle 453. Note that the reduction in pressure at throttle 453 results in a further reduction of temperature of the intermediary fluid stream. A next processing step of method 400-*a* separates a primarily-liquid component (e.g., a LNG liquid and/or a LNG slurry of LNG liquid and frozen $CO_2$) of the intermediary fluid stream at a secondary separation tank 462, thereby producing as output fluid stream 407. In some embodiments, greater than about 85 mass % of the feed gas in input fluid stream 101 may be liquefied into output fluid streams 102 and 407. Thus, method 400-*a* may be referred to as "near-full liquefaction". In some embodiments, an additional fluid stream 408 (e.g., a primarily-gaseous fluid stream) may be produced at secondary separation tank 462. Method 400-*a* may include, for example, burning fluid stream 408 as a low-pressure flare and/or as fuel (e.g., at burner 270 or similar). For example, for an input fluid stream having a specific gravity of about 0.8 and a $CO_2$ concentration of about 2 mol %, an output fluid stream may contained liquefied LNG of about 93 mass % of the input fluid stream. As another example, for an input fluid stream having a specific gravity of about 0.7 and a $CO_2$ concentration of about 5 mol %, an output fluid stream may contain liquefied LNG of about 88 mass % of the input fluid stream. As another example, for an input fluid stream having a specific gravity of about 0.8 and a $CO_2$ concentration of about 10 mol %, an output fluid stream may contain liquefied LNG of about 85 mass % of the input fluid stream.

Figure 4B:
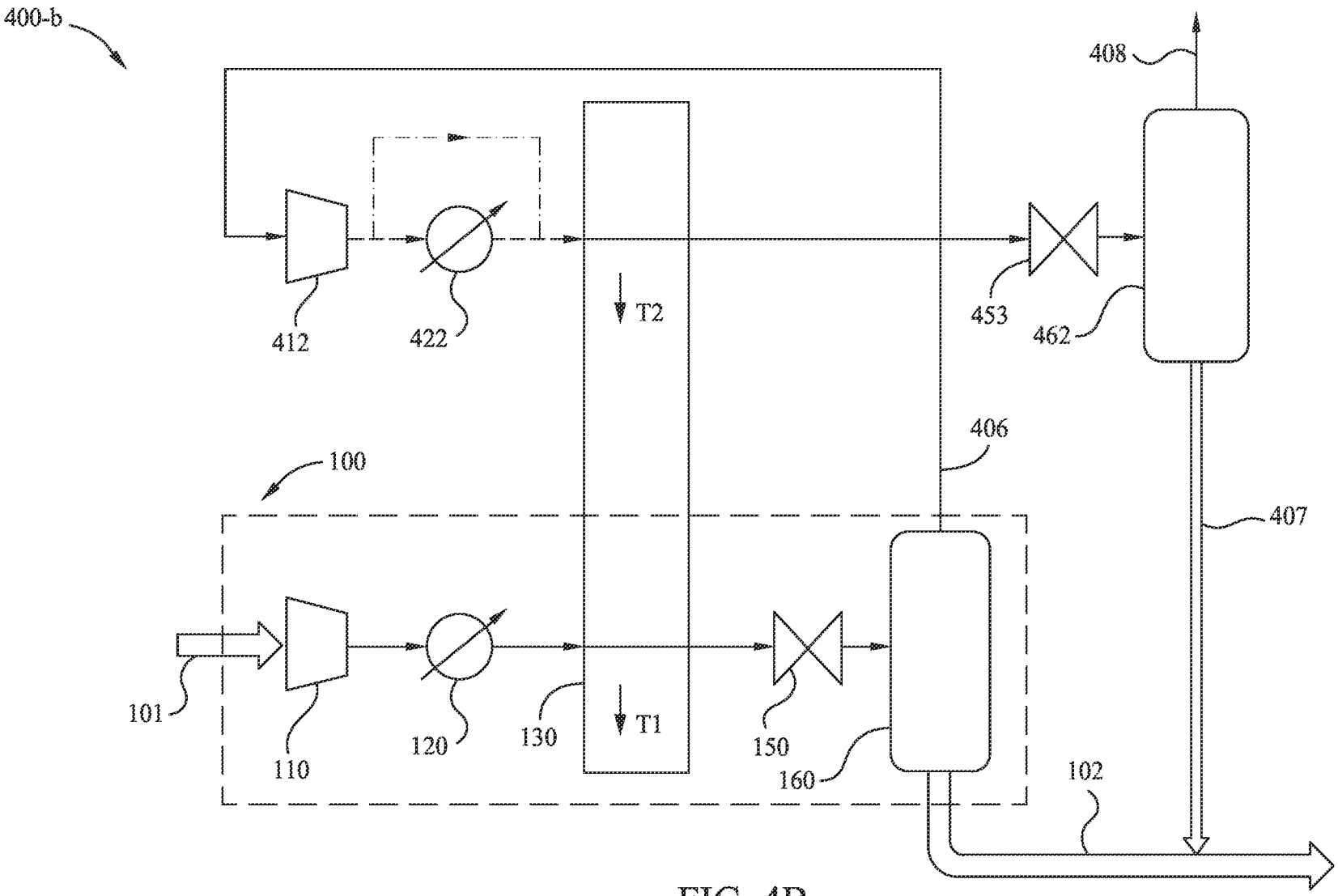
FIGS. 4B, 4C, and 4D illustrate three exemplary variations on the method of FIG. 4A.
Figure 4C:
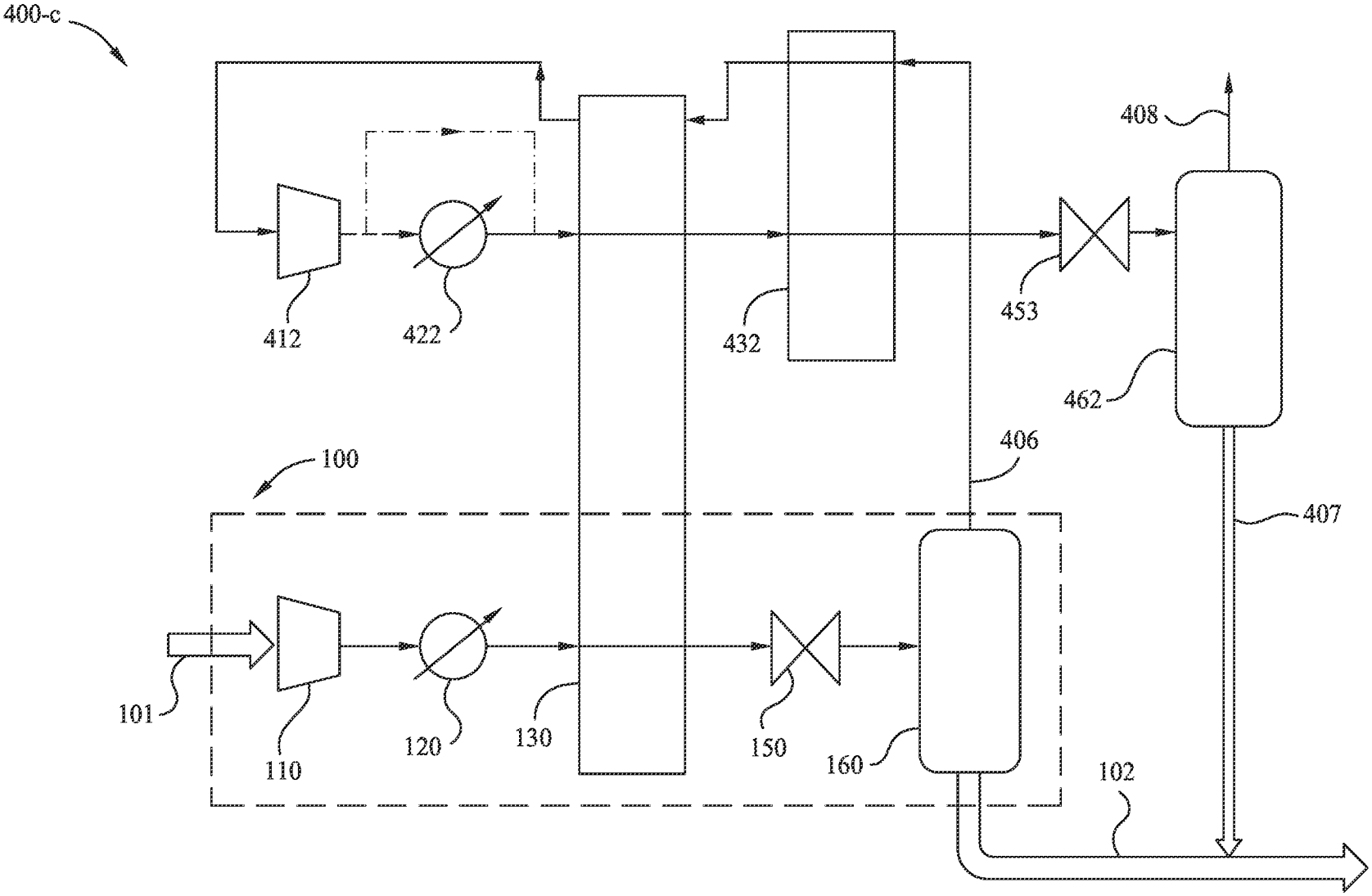
Figure 4D:
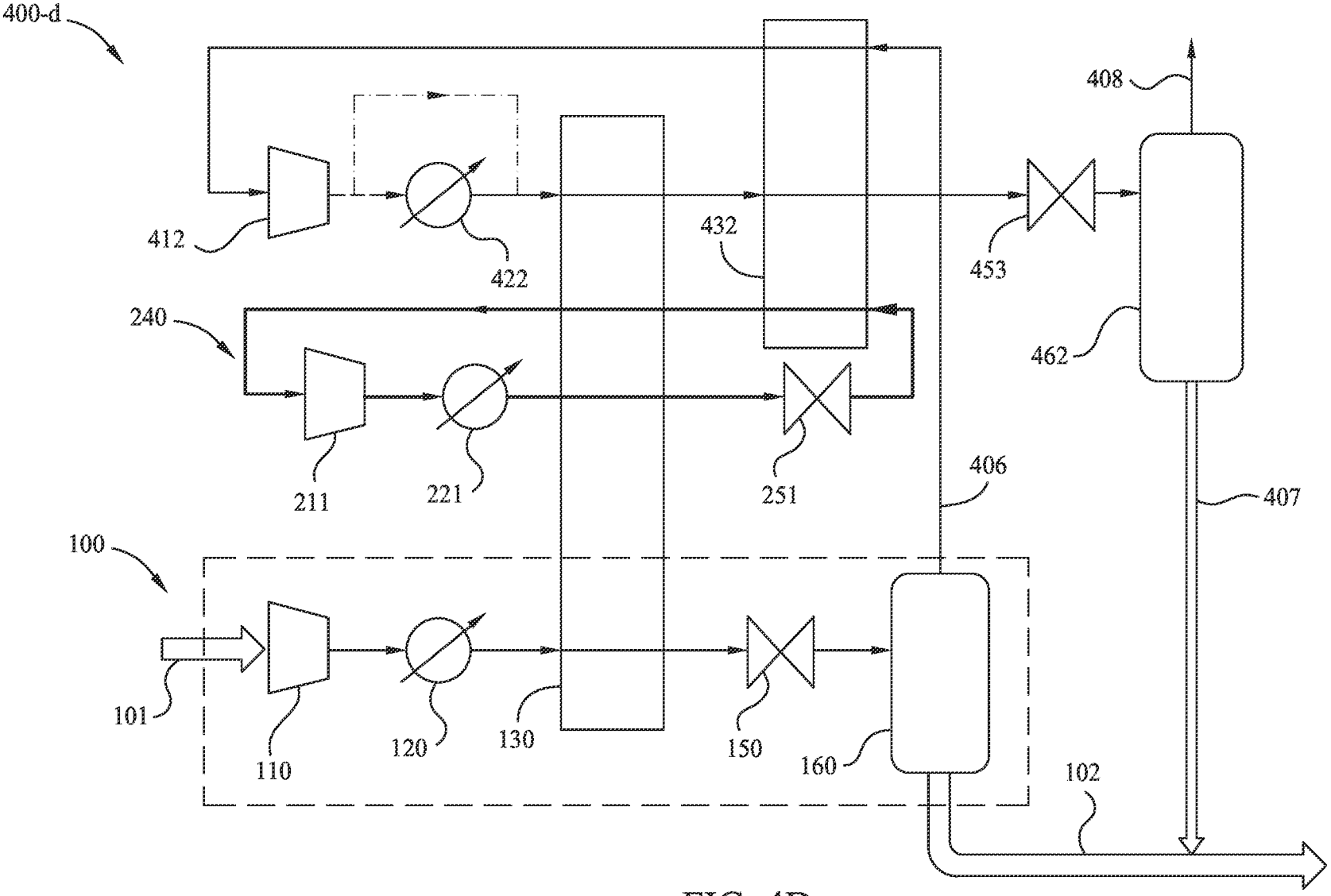

FIGS. 4B, 4C, and 4D illustrate three variations (methods 400-*b*, 400-*c*, and 400-*d*, respectively) of exemplary method 400-*a* for near-full-liquefaction LNG generation according to embodiments disclosed herein. These variations may be more energy efficient than the embodiment shown in FIG. 4A. In FIG. 4B, method 400-*b* replaces the functionality of secondary heat exchanger 432 with further utilization of heat exchanger 130. In FIG. 4C, method 400-*c* supplements the functionality of secondary heat exchanger 432 with further utilization of heat exchanger 130. In FIG. 4D, method 400-*d* utilizes a mixed refrigerant loop 240 to provide cooling fluid streams for heat exchanger 130 and secondary heat exchanger 432.

FIG. 4B illustrates exemplary method 400-*b* of near-full-liquefaction LNG generation according to embodiments disclosed herein. FIG. 4B presents a schematic of an embodiment to liquefy nearly all of the input fluid stream 101. For example, the combined output fluid streams 102 and 407 may account for at least 85 mass % of input fluid stream 101. In some embodiments, the combined output fluid streams 102 and 407 may account for at least 90 mass % of input fluid stream 101. In some embodiments, the combined output fluid streams 102 and 407 may account for at least 93 mass % of input fluid stream 101.

Method 400-*b* includes a first procedure (e.g., method 100) to partially liquefy a production gas which has been dehydrated, but not treated to reduce $CO_2$ content (e.g., input fluid stream 101). The partial liquefaction is performed by compressing the input fluid stream 101 at compressor 110, then cooling this compressed fluid stream through cooler 120 and heat exchanger 130 to a temperature T1. In some embodiments, temperature T1 is near to, but above, the freeze-out temperature for $CO_2$ in the intermediary fluid stream. The heat exchanger 130 may include one or more cooling fluid streams (e.g., one or more mixed refrigerant loops). In some embodiments, the heat exchanger 130 may be designed or operated so that the various cooling fluid streams exit the heat exchanger at differing temperatures. Although unequal exit temperatures may complicate the heat exchanger design and/or operation, such cooling fluid streams may increase the overall efficiency of the system, especially when the intermediary fluid stream has a high $CO_2$ composition (e.g., 5-10 mol % $CO_2$). Note that when the intermediary fluid stream has a high $CO_2$ composition, the temperature of the intermediary fluid stream may most likely be maintained considerably warmer than an otherwise-optimal refrigerant temperature or the temperature of the recompressed non-liquefied gas (e.g., fluid stream 406) to avoid solids accumulation. After cooling the intermediary fluid stream with heat exchanger 130, method 400-*b* expands the fluid stream at throttle 150 to further cool and partially liquefy the fluid stream, and to cause freeze-out of $CO_2$. In some embodiments, the expansion at throttle 150 may be to near-ambient pressure (e.g., about 101 kPa to about 111 kPa). In some embodiments, the expansion at throttle 150 may be to an elevated pressure (e.g., about 150 kPa to about 250 kPa). Note that expansion to an elevated pressure may reduce the volumetric flow of the intermediary fluid stream through subsequent equipment, and thereby reduce the size and/or cost of the subsequent equipment. Method 400-*b* continues by separating a first primarily-liquid component (e.g., a LNG liquid and/or a LNG slurry of LNG liquid and frozen $CO_2$) from non-liquefied gas at separation tank 160, forming output fluid stream 102.

Method 400-*b* also includes a second procedure to further extract LNG from the fluid stream. The non-liquefied gas from the partial-liquefaction procedure becomes fluid stream 406. Note that fluid stream 406 has reduced $CO_2$ content (compared to input fluid stream 101) due to the freeze-out of $CO_2$ during the partial-liquefaction procedure. Method 400-*b* continues by recompressing fluid stream 406 at secondary compressor 412. By supplying the cold fluid stream 406 directly to the secondary compressor 412, the size and power specifications of secondary compressor 412 may be reduced. A next, optional processing step of method 400-*b* reduces the temperature of the intermediary fluid stream at cooler 422. Method 400-*b* continues by re-cooling the intermediary fluid stream to temperature T2 at heat exchanger 130. In some embodiments, the illustrated heat exchanger 130 of FIG. 4B may include two or more physical units that are thermally coupled, a first which cools to a temperature T1, and a second which cools to a temperature of T2. In some embodiments, the illustrated heat exchanger 130 of FIG. 4B is a single unit, having two or more process fluid channels that are thermally coupled, a first which cools to a temperature T1, and a second which cools to a temperature of T2. The intermediary fluid stream is then expanded at throttle 453. Method 400-*b* continues by separating a second primarily-liquid component (e.g., a LNG liquid and/or a LNG slurry of LNG liquid and frozen $CO_2$) at secondary separation tank 462, forming output fluid stream 407. In some embodiments, an additional fluid stream 408 (e.g., a primarily-gaseous fluid stream) may be produced at secondary separation tank 462. Method 400-*b* may include, for example, burning fluid stream 408 as a low-pressure flare and/or as fuel (e.g., at burner 270 or similar). For example, fluid stream 408 may serve as fuel for compressor 150 and/or compressor 453.

FIG. 4C illustrates another exemplary method 400-*c* of near-full-liquefaction LNG generation according to embodiments disclosed herein. Similar to FIG. 4B, FIG. 4C presents a schematic of an embodiment to liquefy nearly all of the input fluid stream 101. Similar to method 400-*b*, method 400-*c* includes a first procedure (e.g., method 100) to partially liquefy input fluid stream 101. However, unlike method 400-*b*, method 400-*c* utilizes secondary heat exchanger 432 to more efficiently use the cooling capacity of fluid stream 406 to further extract LNG from the fluid stream.

After separating a first primarily-liquid component (e.g., fluid stream 102) from a non-liquefied gas (e.g., fluid stream 406) at separation tank 160, method 400-*c* includes utilizing fluid stream 406 as a cooling fluid stream in secondary heat exchanger 432. Method 400-*c* continues by recompressing fluid stream 406 at secondary compressor 412. A next, optional processing step of method 400-*c* reduces the temperature of the intermediary fluid stream at cooler 422. Method 400-*c* continues by re-cooling the intermediary fluid stream at heat exchanger 130. Method 400-*c* continues by further cooling the intermediary fluid stream at secondary heat exchanger 432. Note that the non-liquefied gas of fluid stream 406 is used to further cool the recompressed vapor (i.e., autorefrigeration). The intermediary fluid stream is then expanded at throttle 453. Method 400-*c* continues by separating a second primarily-liquid component (e.g., a LNG liquid and/or a LNG slurry of LNG liquid and frozen $CO_2$) at secondary separation tank 462, forming output fluid stream 407. In some embodiments, an additional fluid stream 408 (e.g., a primarily-gaseous fluid stream) may be produced at secondary separation tank 462. Method 400-*c* may include, for example, burning fluid stream 408 as a low-pressure flare and/or as fuel (e.g., at burner 270 or similar). For example, fluid stream 408 may serve as fuel for compressor 150 and/or compressor 453.

In some embodiments, a mixed refrigerant loop (e.g., mixed refrigerant loop 240 of FIG. 2A or FIG. 2B) may be used to provide a cooling fluid stream for heat exchanger 130 (as illustrated in FIG. 2 A or FIG. 2B). In some embodiments, the mixed refrigerant loop may also provide a cooling fluid stream for secondary heat exchanger 432. For example, in FIG. 4D, method 400-*d* utilizes a mixed refrigerant loop 240 to provide cooling fluid streams for heat exchanger 130 and secondary heat exchanger 432. As illustrated, after the fluid stream of the mixed refrigerant loop is expanded (e.g., at throttle 251), the fluid stream may be sent through the secondary heat exchanger 432 to further aid the cooling of the recompressed vapor from fluid stream 406.

In some embodiments, as an alternate and/or a supplement to a mixed refrigerant loop (e.g., mixed refrigerant loop 240), an open refrigerant loop may be used to provide one or more cooling fluid streams to heat exchanger 130 and/or secondary heat exchanger 432. For example, a consumable cooling fluid (e.g., liquid air and/or liquid nitrogen) may be used as a refrigerant fluid in an open refrigerant loop. In some embodiments, consumable cooling fluid may be generated offsite and transported (e.g., via trucks, containers, or piping) to the site of the production gas liquefaction (e.g., at or near a well site) for use in an open refrigerant loop system (e.g., vented once thermal capacity of the consumable cooling fluid has been spent). Transported consumable cooling fluid may be useful, for example, for liquefaction of production gas at or near a well site. In some embodiments, to enable venting with low environmental impact, the consumable cooling fluid may be liquid nitrogen or liquid air.

Figure 5:
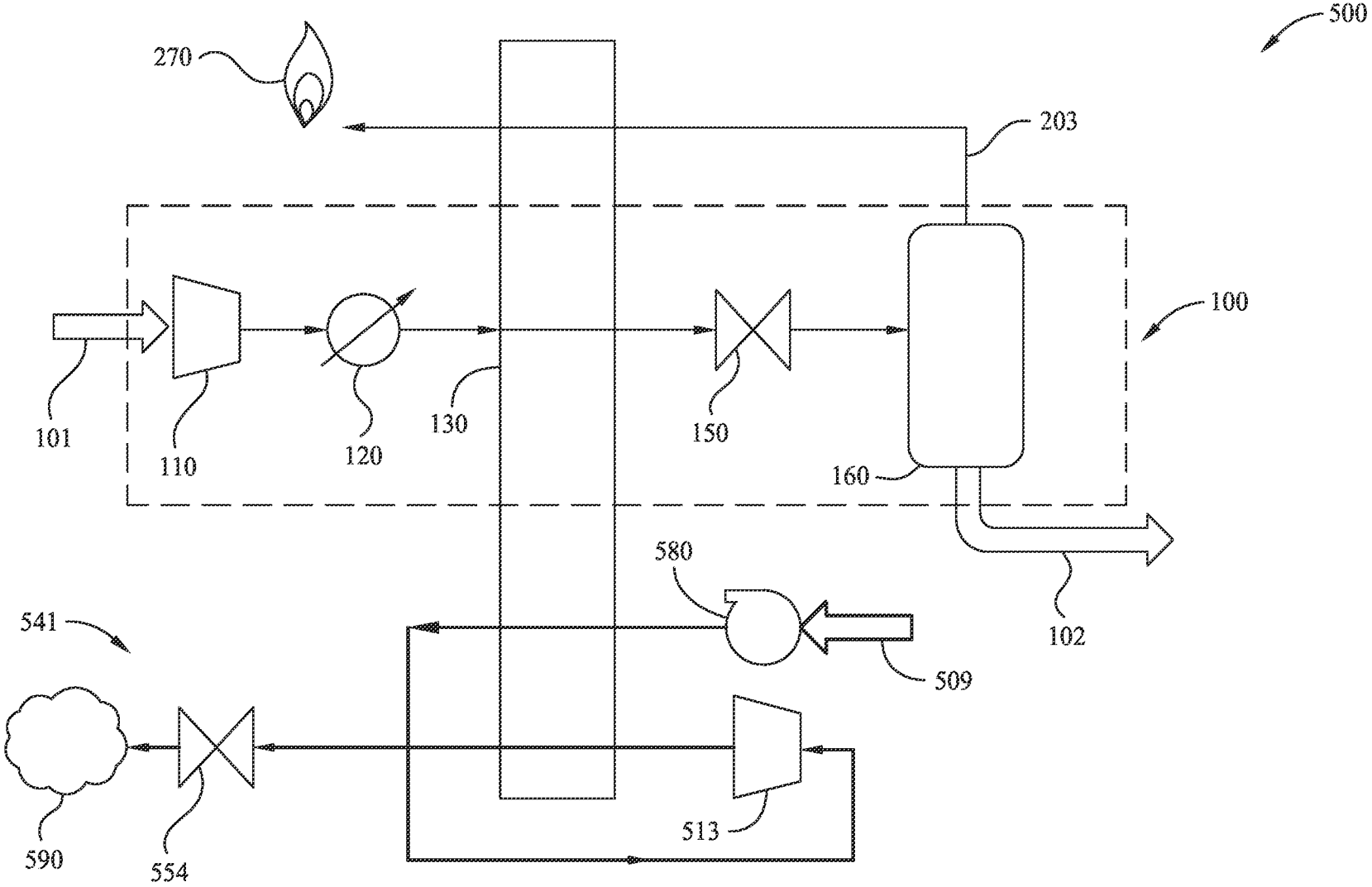
FIG. 5 illustrates an exemplary partial-liquefaction method of LNG generation utilizing an open refrigerant loop according to embodiments disclosed herein.

FIG. 5 illustrates an exemplary partial-liquefaction method 500 of LNG generation utilizing an open refrigerant loop according to embodiments disclosed herein. Many aspects of method 500 are similar to those corresponding aspects in method 200. However, method 500 replaces mixed refrigerant loop 240 with open refrigerant loop 541. As illustrated, input consumable cooling fluid stream 509 is first pumped to an elevated pressure at pump 580. For example, if the consumable cooling fluid is liquid nitrogen, the consumable cooling fluid stream 509 may be pumped to an elevated pressure greater than 1000 kPa, or even greater than about 3000 kPa. The pressurized consumable cooling fluid stream may then be utilized as a cooling fluid by heat exchanger 130 (e.g., to cool dehydrated natural gas to a temperature near to, but above, a temperature at which solids freeze-out). Method 500 continues by expanding the consumable cooling fluid stream at expander 513 (e.g., a turboexpander). Note that expanding the consumable cooling fluid stream acts to cool the consumable cooling fluid stream (e.g., to a temperature that is less than −40° C., and/or less than −80° C.). Method 500 continues by passing the expanded consumable cooling fluid stream through the heat exchanger 130 to further aid cooling of the intermediary fluid stream. In some embodiments, while passing through the heat exchanger 130, the consumable cooling fluid stream is at a modestly elevated pressure (e.g., 150-300 kPa). It should be appreciated that maintaining the consumable cooling flood at a modestly elevated pressure may reduce the flow volume, and hence physical size, of piping in the heat exchanger 130. Method 500 continues by further expanding the consumable cooling fluid stream at throttle 554, and then venting the consumable cooling fluid at vent 590.

Figure 6:
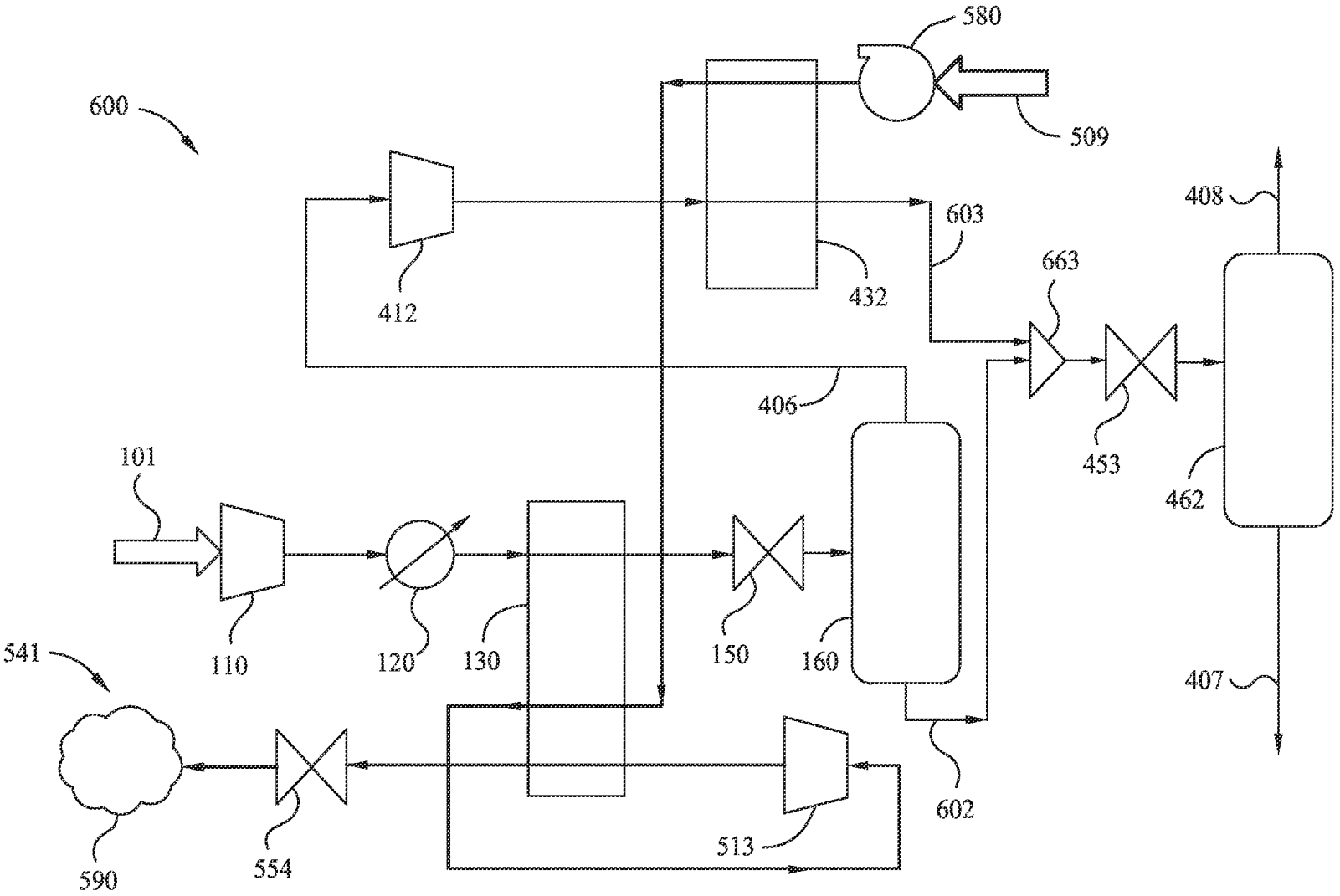
FIG. 6 illustrates an exemplary near-full-liquefaction method of LNG generation utilizing an open refrigerant loop according to embodiments disclosed herein.

FIG. 6 illustrates an exemplary near-full-liquefaction method 600 of LNG generation utilizing an open refrigerant loop according to embodiments disclosed herein. Many aspects of method 600 are similar to those corresponding aspects in method 400-*a*. However, method 600 utilizes an open refrigerant loop 642 to provide one or more cooling fluid streams to heat exchanger 130 and/or secondary heat exchanger 432. Method 600 also utilizes a combiner 663 to combine intermediary fluid stream 602 (non-gaseous fluid from separator tank 160) with intermediary fluid stream 603 (re-cooled fluid stream from secondary heat exchanger 432) prior to expansion at throttle 453 to reduce the pressures of the fluid streams. Note that fluid stream 602 may exit separator tank 160 at elevated pressure (e.g., 200 kPa). As illustrated, method 600 includes pumping input consumable cooling fluid stream 509 to an elevated pressure at pump 580. The consumable cooling fluid stream is then used at secondary heat exchanger 432 to cool the non-liquefied gas (e.g., fluid stream 406) from the first separator tank 160. Subsequently, method 600 passes the consumable cooling fluid stream through heat exchanger 130 to cool the intermediary fluid stream to a temperature near to, but above, that which solids form. The consumable cooling fluid stream is then expanded at expander 513 (similar to method 500). Method 600 continues by passing the expanded consumable cooling fluid stream through the heat exchanger 130 to further aid cooling of the intermediary fluid stream. Note that the fluid stream 406 from the first separator tank 160 may be modestly compressed (for example from about 200 kPa to about 350 kPa) at secondary compressor 412. As such, it should be expected that the intermediary fluid stream passing through secondary heat exchanger 432 may be fully condensed with the consumable cooling fluid stream (e.g., liquid nitrogen) without freezing-out any solids (e.g., $CO_2$). For example, the compression at secondary compressor 412 may be such that the bubble-point temperature of the intermediary fluid stream at the compressed pressure is raised slightly above the temperature of separator 160 (e.g., by about 1° C., 2° C., or 5° C.). If the intermediary fluid stream was not compressed, cooling to a condensation temperature at secondary heat exchanger 432 may quickly form $CO_2$ solids, since the intermediary fluid stream was in equilibrium with solid $CO_2$ in the first separator tank 160. Compression at secondary compressor 412 thus facilitates liquefaction at a higher temperature while preventing solids formation in secondary heat exchanger 432.

The foregoing description is directed to particular example embodiments of the present technological advancement. It will be apparent, however, to one skilled in the art, that many modifications and variations to the embodiments described herein are possible. All such modifications and variations are intended to be within the scope of the present disclosure, as defined in the appended claims.

What is claimed is:

1. A method, comprising:

compressing an input fluid stream comprising at least natural gas and carbon dioxide to generate a first intermediary fluid stream;

cooling the first intermediary fluid stream with a first heat exchanger to generate a second intermediary fluid stream, wherein a temperature of the second intermediary fluid stream is higher than a carbon dioxide-freezing temperature for the second intermediary fluid stream;

expanding the second intermediary fluid stream to generate a third intermediary fluid stream, wherein the third intermediary fluid stream is introduced directly to a separator and the third intermediary fluid stream comprises solid carbon dioxide and a pressure of the third intermediary fluid stream is lower than that of the second intermediary fluid stream;

separating the third intermediary fluid stream in the separator to produce a fourth intermediary fluid stream and a first output fluid stream, wherein the first output fluid stream comprises a slurry of liquefied natural gas (LNG) liquid and the solid carbon dioxide, and the fourth intermediary fluid stream is a gaseous stream;

utilizing the fourth intermediary fluid stream as a cooling fluid stream for a second heat exchanger, thereby generating a fifth intermediary fluid stream;

wherein the fourth intermediary fluid stream is introduced directly to the second heat exchanger;

compressing the fifth intermediary fluid stream to generate a sixth intermediary fluid stream;

cooling the sixth intermediary fluid stream within the first heat exchanger followed by further cooling within the second heat exchanger to generate a seventh intermediary fluid stream, wherein a temperature of the seventh intermediary fluid stream is higher than a carbon dioxide-freezing temperature for the seventh intermediary fluid stream;

expanding the seventh intermediary fluid stream to generate an eighth intermediary fluid stream, wherein the eighth intermediary fluid stream comprises solid carbon dioxide;

separating a second output fluid stream from the eighth intermediary fluid stream, wherein the second output fluid stream comprises a second portion of LNG liquid; and combining the first output fluid stream with the second output fluid stream to form a combined output fluid stream;

wherein the combined output fluid stream is obtained in an amount that is at least about 85% of a mass input of the input fluid stream.

2. The method of claim 1, further comprising utilizing the fifth intermediary fluid stream as a cooling stream for the first heat exchanger prior to compression.

3. The method of claim 1, wherein the temperature of the seventh intermediary fluid stream is less than the temperature of the second intermediary fluid stream.

4. The method of claim 1, wherein the sixth intermediary fluid stream has a $CO_2$ mole fraction that is at least 5 times less than a $CO_2$ mole fraction of the second intermediary fluid stream.

5. The method of claim 1, wherein the input fluid stream further comprises an associated gas.

6. The method of claim 5, wherein the associated gas has a specific gravity of 0.70 to 0.85.

7. The method of claim 1, wherein the input fluid stream is dehydrated of water sufficiently that neither water nor hydrates form in the first heat exchanger.

8. The method of claim 1, wherein the input fluid stream comprises:

between 0.65 and 0.85 mole fraction methane on a $CO_2$-free and water free-basis; and at least 0.15 mole fraction $C_{2+}$ hydrocarbons on a $CO_2$-free and water free-basis.

9. The method of claim 8, wherein the input fluid stream has a concentration of carbon dioxide of between 0.001 and 0.100 mole fraction on a water-free basis.

10. The method of claim 1, wherein 70 mass % to 80 mass % of the input fluid stream is extracted in the first output fluid stream.

11. The method of claim 1, wherein a pressure of the first intermediary fluid stream is at least 1500 kPa.

12. The method of claim 1, wherein the pressure of the third intermediary fluid stream is 101 kPa or above.

13. The method of claim 12, wherein the pressure of the third intermediary fluid stream is at least 150 kPa.

14. The method of claim 1, wherein the fourth intermediary fluid stream comprises less than 0.01 mole fraction $C_{2+}$ hydrocarbons.

15. The method of claim 1, further comprising utilizing a mixed refrigerant loop to provide a second cooling fluid stream for at least the first heat exchanger.

16. The method of claim 15, wherein the mixed refrigerant loop includes a mixed refrigerant comprising:

nitrogen;

methane;

$C_2$ hydrocarbons; and $C_{4+}$ hydrocarbons, wherein:

a sum of mole fractions of each of the nitrogen, the methane, and the $C_2$ hydrocarbons is at least 0.50 mole fraction, and a concentration of the $C_{4+}$ hydrocarbons is at least 0.20 mole fraction.

* * * * *